US011466928B2

(12) United States Patent
Hong

(10) Patent No.: US 11,466,928 B2
(45) **Date of Patent: *Oct. 11, 2022**

(54) REFRIGERATOR

(71) Applicant: LG ELECTRONICS INC., Seoul (KR)

(72) Inventor: EuDdeum Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 156 days.

This patent is subject to a terminal disclaimer.

(21) Appl. No.: 16/583,726

(22) Filed: Sep. 26, 2019

(65) Prior Publication Data

US 2021/0010748 A1 Jan. 14, 2021

(30) Foreign Application Priority Data

Jul. 12, 2019 (KR) ..... 10-2019-0084443

(51) Int. Cl.

| | |
|---|---|
| ***A47B 88/90*** | (2017.01) |
| ***F25D 25/02*** | (2006.01) |
| ***F25D 23/02*** | (2006.01) |
| ***F25D 25/00*** | (2006.01) |
| ***B66F 7/06*** | (2006.01) |

(52) U.S. Cl.

CPC ..... *F25D 25/005* (2013.01); *B66F 7/065* (2013.01); *F25D 25/025* (2013.01); *A47B 2088/901* (2017.01); *F25D 23/021* (2013.01); *F25D 2325/021* (2013.01)

(58) Field of Classification Search

CPC ..... F25D 25/005; F25D 25/025; F25D 2325/021; B66F 7/065; A47B 2088/901

See application file for complete search history.

(56) References Cited

U.S. PATENT DOCUMENTS

| | | | |
|---|---|---|---|
| 658,999 | A | 10/1900 | Scannel |
| 1,067,404 | A | 7/1913 | Callaghan |
| 2,072,244 | A | 3/1937 | Coursen |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

Chinese Office Action dated Sep. 3, 2021 issued in CN Application No. 201910905106.9.

(Continued)

*Primary Examiner* — Kimberley S Wright

(74) *Attorney, Agent, or Firm* — KED & Associates, LLP

(57) ABSTRACT

A refrigerator includes a lift that moves a container upward and downward. The refrigerator may include: a cabinet having a storage chamber provided therein and an opening; at least one door provided such that a front of the storage chamber provided in the cabinet is opened and closed; a cooling device cooling the storage chamber; the lift provided at a side of the storage chamber to fold downward and unfold upward so as to move the container upward and downward; and an anti-loosening device provided at a side of the lift and allowing the lift to rotate relative to a front end thereof when the lift is removed upward so as to maintain a folded state of the lift.

22 Claims, 17 Drawing Sheets

(56) References Cited

U.S. PATENT DOCUMENTS

| | | | |
|---|---|---|---|
| 2,679,658 | A | 6/1954 | McCormick |
| 2,731,318 | A | 1/1956 | Hoff |
| 4,545,628 | A | 10/1985 | Richey |
| 5,253,488 | A | 10/1993 | Kim et al. |
| 6,044,606 | A | 4/2000 | Hamar |
| 6,109,774 | A | 8/2000 | Holmes et al. |
| 6,371,584 | B1 | 4/2002 | Alreck |
| 6,722,749 | B1 | 4/2004 | Pagac |
| 7,600,829 | B2 | 10/2009 | Oh et al. |
| 7,600,830 | B2 | 10/2009 | Oh et al. |
| 7,600,833 | B2 | 10/2009 | Oh et al. |
| 7,690,586 | B2 | 4/2010 | Kang |
| 8,282,177 | B1 | 10/2012 | Rotter |
| 8,360,539 | B2 | 1/2013 | Brown et al. |
| 8,376,481 | B2 | 2/2013 | Lee |
| 8,497,644 | B2 | 7/2013 | Eom et al. |
| 8,668,289 | B2 | 3/2014 | Lee et al. |
| 8,794,722 | B2 | 8/2014 | Nuss et al. |
| 8,844,110 | B2 | 9/2014 | Rotter |
| 8,864,249 | B2 | 10/2014 | Nam et al. |
| 9,107,494 | B2 | 8/2015 | Scheuring et al. |
| 9,377,238 | B2 | 6/2016 | Hall et al. |
| 9,523,533 | B2 | 12/2016 | Nam et al. |
| 9,982,937 | B2 | 5/2018 | Tierney et al. |
| 10,234,195 | B2 | 3/2019 | Yasaka et al. |
| 10,465,970 | B1 | 11/2019 | Kang et al. |
| 10,598,428 | B2 | 3/2020 | Kim |
| 10,690,401 | B2 | 6/2020 | Yang et al. |
| 10,712,083 | B1 | 7/2020 | Choi |
| 10,767,920 | B1 | 9/2020 | Choi |
| 10,786,080 | B1 | 9/2020 | Stravitz et al. |
| 10,876,788 | B2 | 12/2020 | Choi |
| 10,932,568 | B2 | 3/2021 | Subrahmanya et al. |
| 10,939,758 | B2 | 3/2021 | Kim |
| 11,033,104 | B2 | 6/2021 | Kim |
| 11,047,619 | B2 | 6/2021 | Choi |
| 11,131,500 | B2 | 9/2021 | Kim |
| 2003/0201700 | A1 | 10/2003 | Cho |
| 2004/0031705 | A1 | 2/2004 | Detemple, II et al. |
| 2004/0046488 | A1 | 3/2004 | Hogan |
| 2004/0056573 | A1 | 3/2004 | Chae |
| 2006/0042306 | A1 | 3/2006 | Choi et al. |
| 2006/0087207 | A1 | 4/2006 | Oh et al. |
| 2006/0087208 | A1 | 4/2006 | Oh et al. |
| 2006/0207283 | A1 | 9/2006 | Kim et al. |
| 2006/0248916 | A1 | 11/2006 | Kim et al. |
| 2006/0250062 | A1 | 11/2006 | Janda et al. |
| 2007/0262686 | A1 | 11/2007 | Ji |
| 2008/0018215 | A1 | 1/2008 | Carden et al. |
| 2009/0045713 | A1 | 2/2009 | Kunkle et al. |
| 2009/0160298 | A1 | 6/2009 | Chen et al. |
| 2009/0167131 | A1 | 7/2009 | Oh et al. |
| 2009/0277210 | A1 | 11/2009 | Eveland et al. |
| 2010/0192621 | A1 | 8/2010 | Kim |
| 2010/0236279 | A1 | 9/2010 | Eom et al. |
| 2010/0239795 | A1 | 9/2010 | Gat |
| 2010/0283365 | A1 | 11/2010 | Chen |
| 2011/0005264 | A1 | 1/2011 | Lee et al. |
| 2011/0006656 | A1 | 1/2011 | Nam et al. |
| 2011/0050065 | A1 | 3/2011 | Lee et al. |
| 2011/0050066 | A1 | 3/2011 | Lee et al. |
| 2011/0146333 | A1 | 6/2011 | Koo et al. |
| 2011/0162402 | A1 | 7/2011 | Park |
| 2011/0181163 | A1 | 7/2011 | Han et al. |
| 2011/0210655 | A1 | 9/2011 | Brown et al. |
| 2012/0091872 | A1 | 4/2012 | Matthes et al. |
| 2012/0125035 | A1 | 5/2012 | Chellappan et al. |
| 2012/0306338 | A1 | 12/2012 | Nagahata et al. |
| 2013/0055543 | A1 | 3/2013 | Rotter |
| 2013/0129267 | A1 | 5/2013 | Chen |
| 2013/0145972 | A1* | 6/2013 | Knox ..... B60N 2/24 108/145 |
| 2013/0264928 | A1 | 10/2013 | Hong et al. |
| 2013/0270986 | A1 | 10/2013 | Min et al. |
| 2013/0270987 | A1 | 10/2013 | Kelly |
| 2013/0270989 | A1 | 10/2013 | Park et al. |
| 2014/0191646 | A1 | 7/2014 | Nuss et al. |
| 2014/0265783 | A1 | 9/2014 | Hauer et al. |
| 2014/0265797 | A1 | 9/2014 | Scheuring et al. |
| 2014/0265806 | A1* | 9/2014 | Hall ..... F25D 25/025 312/408 |
| 2014/0319990 | A1 | 10/2014 | Gephart et al. |
| 2015/0059398 | A1 | 3/2015 | Yoo et al. |
| 2015/0059399 | A1 | 3/2015 | Hwang et al. |
| 2015/0069899 | A1 | 3/2015 | Han et al. |
| 2015/0184918 | A1 | 7/2015 | Klingshirn et al. |
| 2016/0146533 | A1 | 5/2016 | Jung |
| 2016/0153704 | A1 | 6/2016 | Burke et al. |
| 2016/0178274 | A1 | 6/2016 | Shin |
| 2016/0265816 | A1 | 9/2016 | Gillette et al. |
| 2016/0305705 | A1 | 10/2016 | Dubina et al. |
| 2016/0320118 | A1 | 11/2016 | Millett |
| 2016/0370063 | A1 | 12/2016 | Yang |
| 2017/0024946 | A1 | 1/2017 | Hashemi et al. |
| 2017/0051967 | A1 | 2/2017 | Tierney et al. |
| 2017/0122651 | A1 | 5/2017 | Cizik et al. |
| 2017/0227279 | A1 | 8/2017 | Yang et al. |
| 2017/0336129 | A1 | 11/2017 | Cunningham |
| 2017/0362864 | A1 | 12/2017 | Fazi et al. |
| 2018/0128540 | A1 | 5/2018 | Yasaka et al. |
| 2018/0283771 | A1 | 10/2018 | Shin et al. |
| 2018/0291669 | A1 | 10/2018 | Kim et al. |
| 2018/0356148 | A1 | 12/2018 | Fei et al. |
| 2019/0219324 | A1 | 7/2019 | Kang |
| 2019/0242640 | A1 | 8/2019 | Minoru et al. |
| 2019/0292831 | A1 | 9/2019 | Choi |
| 2019/0293341 | A1 | 9/2019 | Yeom |
| 2019/0323763 | A1 | 10/2019 | Kang |
| 2019/0346199 | A1 | 11/2019 | Choi |
| 2019/0390895 | A1 | 12/2019 | Choi |
| 2020/0011593 | A1 | 1/2020 | Ji |
| 2020/0069056 | A1 | 3/2020 | Kim |
| 2020/0072533 | A1 | 3/2020 | Cho |
| 2020/0072540 | A1 | 3/2020 | Kim |
| 2020/0072542 | A1 | 3/2020 | Kim |
| 2021/0003337 | A1 | 1/2021 | Voltarelli et al. |
| 2021/0259416 | A1 | 8/2021 | Kim |

FOREIGN PATENT DOCUMENTS

| | | |
|---|---|---|
| CN | 102226626 | 10/2011 |
| CN | 202254607 | 5/2012 |
| CN | 202970226 | 6/2013 |
| CN | 204902419 | 12/2015 |
| CN | 107388718 | 11/2017 |
| CN | 108645104 | 10/2018 |
| CN | 109028726 | 12/2018 |
| CN | 208640001 | 3/2019 |
| CN | 109690213 | 4/2019 |
| CN | 208736030 | 4/2019 |
| CN | 109838961 | 6/2019 |
| CN | 109990557 | 7/2019 |
| CN | 110873500 | 3/2020 |
| DE | 29620152 | 4/1997 |
| DE | 10 2005 016 418 | 11/2005 |
| EP | 1 724 540 | 11/2006 |
| EP | 2 299 215 | 3/2011 |
| EP | 2 752 632 | 7/2014 |
| EP | 3 023 721 | 5/2016 |
| EP | 3 505 854 | 7/2019 |
| EP | 3 546 862 | 10/2019 |
| EP | 3 617 630 | 3/2020 |
| GB | 2108564 | 5/1983 |
| JP | H04-138337 | 12/1992 |
| JP | H07-275049 | 10/1995 |
| JP | H08-303944 | 11/1996 |
| JP | 2001-280824 | 10/2001 |
| JP | 2002-264943 | 9/2002 |
| KR | 10-2006-0025806 | 3/2006 |
| KR | 10-2006-0027592 | 3/2006 |
| KR | 10-2006-0053420 | 5/2006 |
| KR | 10-2007-0075671 | 7/2007 |
| KR | 10-2008-0101335 | 11/2008 |
| KR | 10-2009-0027111 | 3/2009 |

(56) References Cited

FOREIGN PATENT DOCUMENTS

| | | |
|---|---|---|
| KR | 10-2009-0027112 | 3/2009 |
| KR | 10-2009-0102576 | 9/2009 |
| KR | 10-2009-0102577 | 9/2009 |
| KR | 10-0921380 | 10/2009 |
| KR | 10-2009-0114265 | 11/2009 |
| KR | 10-2010-0012544 | 2/2010 |
| KR | 10-0946784 | 3/2010 |
| KR | 10-2010-0078916 | 7/2010 |
| KR | 10-2011-0015331 | 2/2011 |
| KR | 20-0460442 | 6/2012 |
| KR | 10-2013-0071919 | 7/2013 |
| KR | 10-2014-0037474 | 3/2014 |
| KR | 10-2018-0138083 | 12/2018 |
| KR | . 10-2018-0138085 | 12/2018 |
| KR | 10-2019-0081331 | 7/2019 |
| WO | 92/14522 | 9/1992 |
| WO | WO 03/016661 | 2/2003 |
| WO | /O 2018/051963 | 3/2018 |
| WO | WO 2019/242234 | 12/2019 |

OTHER PUBLICATIONS

United States Office Action dated Nov. 19, 2020 issued in U.S. Appl. No. 16/582,831.
European Search Report dated Mar. 12, 2020 issued in EP Application No. 19199586.9.
European Search Report dated Mar. 17, 2020 issued in EP Application No. 19199553.9.
European Search Report dated Mar. 20, 2020 issued in EP Application No. 19199569.5.
European Search Report dated Mar. 30, 2020 issued in EP Application No. 19199556.2.
European Search Report dated Apr. 3, 2020 issued in EP Application No. 19199625.5.
European Search Report dated Apr. 6, 2020 issued in EP Application No. 19199629.7.
European Search Report dated Apr. 6, 2020 issued in EP Application No. 19199587.7.
European Search Report dated Apr. 7, 2020 issued in EP Application No. 19199607.3.
European Communication dated Feb. 8, 2021 issued in Application No. 19199627.1.
European Search Report dated Aug. 14, 2020 issued in EP Application No. 19199647.9.
European Office Action dated Sep. 30, 2020 issued in EP Application No. 19199556.2.
European Search Report dated Apr. 1, 2020 issued in EP Application No. 19199637.0.
United States Office Action dated Mar. 4, 2020 issued in U.S. Appl. No. 16/582,712.
United States Office Action dated Mar. 9, 2020 issued in U.S. Appl. No. 16/582,810.
European Search Report dated Mar. 23, 2020 issued in EP Application No. 19199602.4.
United States Office Action dated Jan. 31, 2022 issued in co-pending related U.S. Appl. No. 16/582,756.
United States Office Action dated Feb. 2, 2022 issued in co-pending related U.S. Appl. No. 16/582,605.
United States Office Action dated Oct. 15, 2021 issued in co-pending related U.S. Appl. No. 16/582,755.
GE (Refrigerator Freezer Door Pops Open, https:/ /products.geapplicances.com/appliance/gea-support-search-content?contentId=16979) (Year: 2015).
United States Office Action dated Apr. 11, 2022 issued in co-pending related U.S. Appl. No. 16/585,301.
United States Office Action dated Oct. 6, 2021 issued in co-pending related U.S. Appl. No. 16/582,647.
United States Office Action dated Oct. 6, 2021 issued in co-pending related U.S. Appl. No. 16/582,668.
Chinese Office Action dated Aug. 24, 2021 issued in CN Application No. 201910911796.9.
Chinese Office Action dated Sep. 8, 2021 issued in CN Application No. 201910857458.1.
Chinese Office Action dated Sep. 14, 2021 issued in CN Application No. 201910905166.0.
European Office Action dated Sep. 1, 2021 issued in EP Application No. 19199607.3.
United States Notice of Allowance dated Feb. 23, 2022 issued in co-pending related U.S. Appl. No. 16/582,518.
United States Notice of Allowance dated Feb. 23, 2022 issued in co-pending related U.S. Appl. No. 16/585,284.
Chinese Office Action dated Aug. 20, 2021 issued in CN Application No. 201910857469.X.
Chinese Office Action dated Aug. 25, 2021 issued in CN Application No. 201910911807.3.
Chinese Office Action dated Sep. 2, 2021 issued in CN Application No. 201910871084.9.
Chinese Office Action dated Sep. 17, 2021 issued in CN Application No. 201910905094.X.
Chinese Office Action dated May 16, 2022 issued in CN Application No. 201910905106.9.

* cited by examiner

REFRIGERATOR

CROSS-REFERENCE TO RELATED APPLICATION(S)

The present application claims priority to Korean Patent Application No. 10-2019-0084443, filed in Korea on Jul. 12, 2019, the entire contents of which is incorporated herein for all purposes by this reference.

BACKGROUND

1. Field

The present disclosure generally relates to a refrigerator.

2. Background

A refrigerator is an appliance that includes a cabinet defining an interior storage chamber that is maintained at a relatively cool temperature. For example, the refrigerator may generate generates cold air to cool the storage chamber by circulation of a refrigerant according to a refrigeration cycle.

A refrigerator may include various types of mechanisms that provide access to the storage chamber via an opening in the cabinet and seal the opening. For example, the refrigerator may include a swinging door and/or a sliding drawer. A hybrid-type refrigerator may include both a door and a drawer. One example of a hybrid-type refrigerator has a structure in which a swinging door is provided in an upper portion of the cabinet and a drawer is provided in a lower portion thereof.

A drawer may include a front panel and a storage bin. The front panel may form a front surface of the refrigerator and may provide a handling surface to receive a user-applied force to slide the drawer in or out of an interior of the cabinet. The storage bin may be provided at a rear of the front panel to be selectively inserted into or removed from the interior of the cabinet based on the user-applied force to the front panel. Accessing the drawer provided at the lower part of the cabinet to insert or remove stored items may be inconvenient to a user.

Various structures have been developed to provide a drawer that can be moved upward or downward. Representatively, U.S. Pat. No. 9,377,238 describes a refrigerator having a lifting mechanism to move a bin up or down. However, the lifting mechanism for moving a bin upward or downward may have a structure that is positioned outside of the bin or otherwise exposed, so that the lifting mechanism may have an undesirable appearance and may have safety concerns due to a user contact with the lifting mechanism. Furthermore, it may be difficult to separate and remove the lifting mechanism from the refrigerating chamber.

The above reference is incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
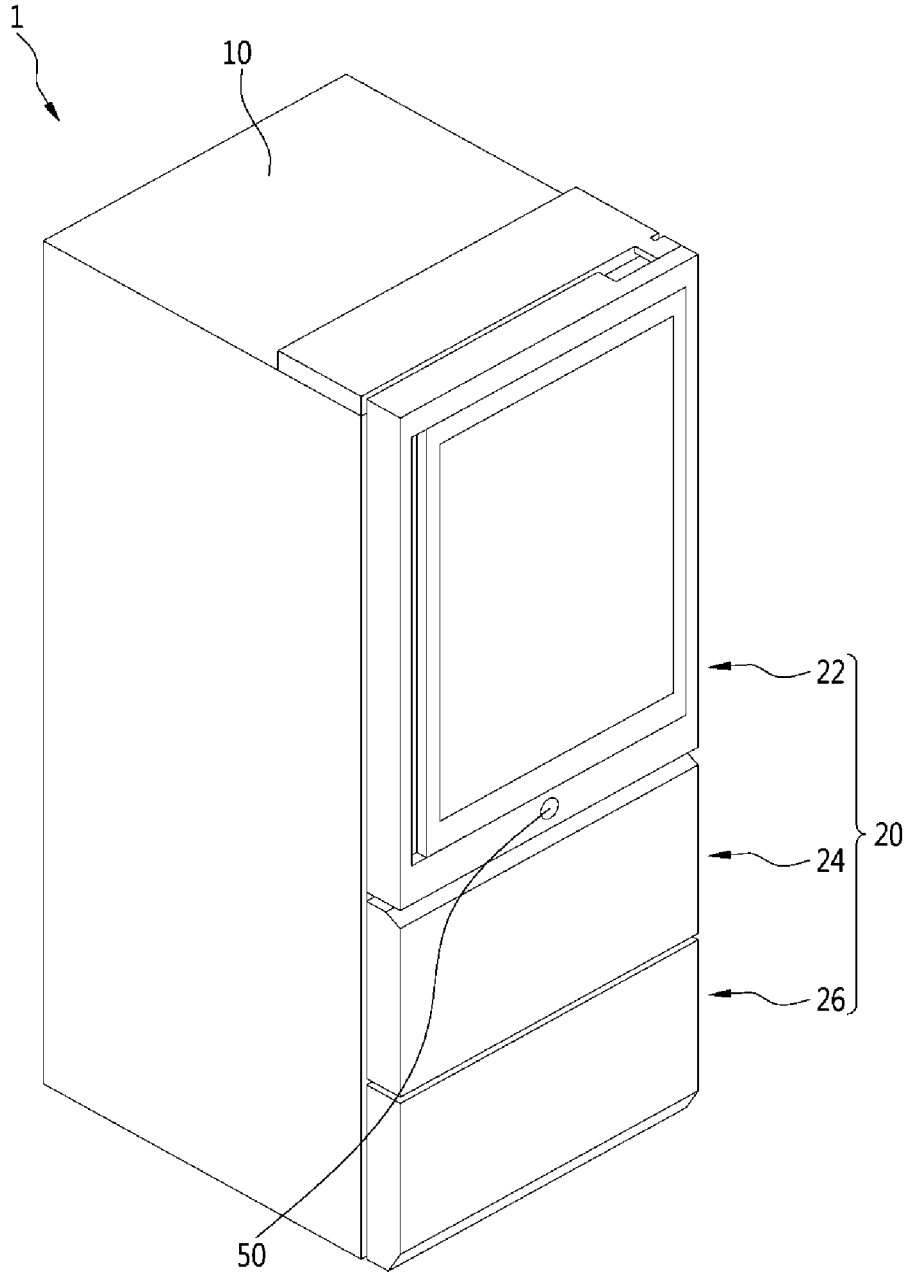
FIG. 1 is a perspective view illustrating configuration of an exemplary embodiment of the refrigerator according to the present disclosure.
Figure 2:
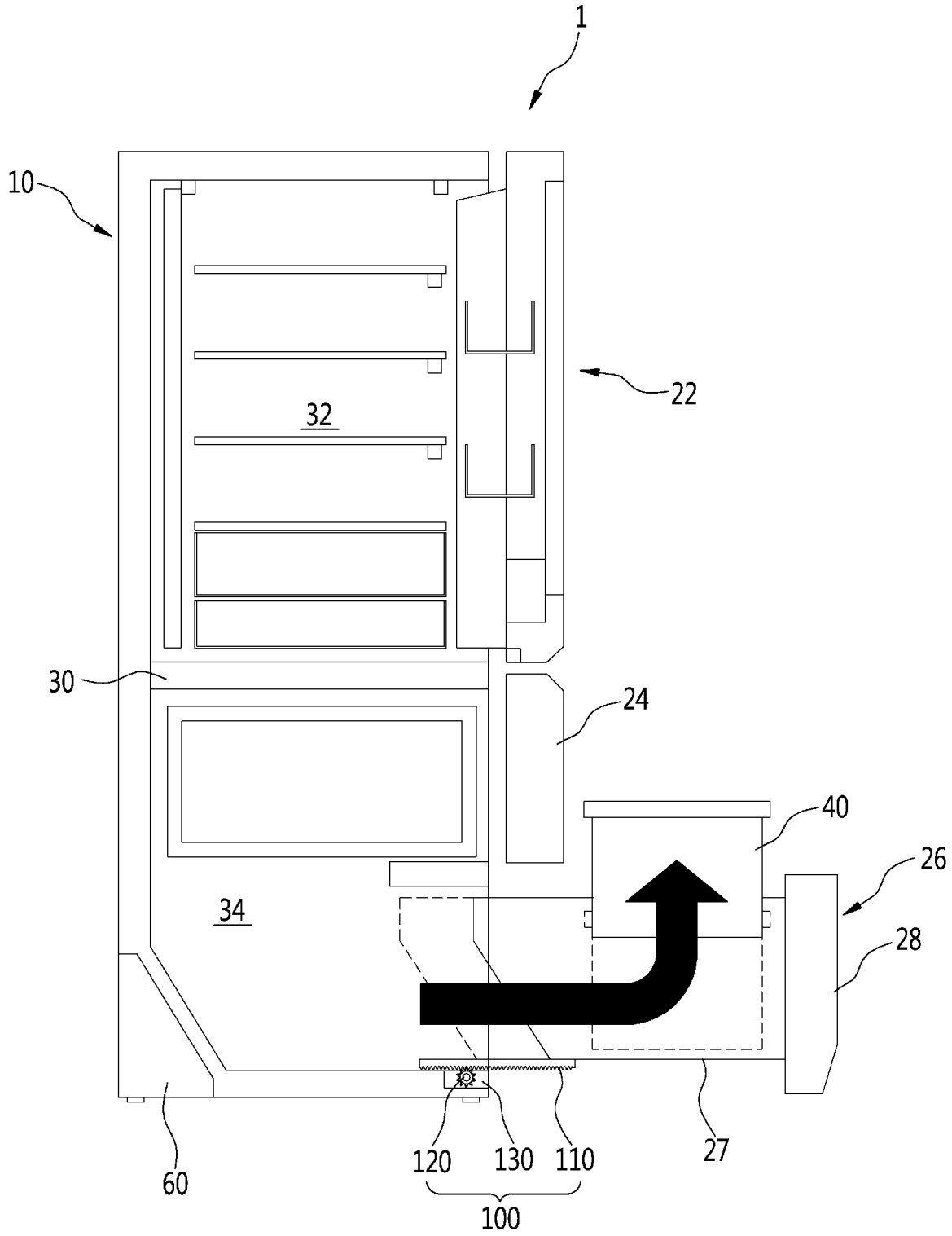
FIG. 2 is a sectional view of the refrigerator illustrating a state of a container moved upward by a lift according to the present disclosure.

As illustrated in FIGS. 1 and 2, a refrigerator 1 may be formed to have a particular volume (e.g., as a hollow) hexahedron and may be include a storage chamber for storing food or other items therein. For example the refrigerator includes: a cabinet 10 include a space including the storage chamber therein and an open surface thereof (a front thereof); and at least one door 20 covering the open surface (the front) of the cabinet 10. A cooling device, such as components of a refrigeration cycle, may be provided in the refrigerator 1 to cool the storage chamber.

Referring to FIG. 1, the cabinet 10 of the refrigerator 1 may be configured such that the front thereof may be open, and the door 20 covers the front of the cabinet 10. An inner part of the cabinet 10 may be partitioned into multiple spaces. For example, a space of the storage chamber provided in the cabinet 10 may be divided by at least one inner wall 30.

For example, the space may be divided into upper and lower spaces by the parallel inner wall 30. For example, the cabinet 10 may include an upper space 32 on an upper side thereof and a lower space 34 provided on a lower side thereof relative to the inner wall 30. For example, the upper space 32 may be used as a refrigerating compartment and the lower space 34 may be used as a freezer compartment. In other examples, a role of the upper space 32 and a role of the lower space 34 may be differ, such as using the upper space 32 and the lower space 34 as a refrigerating compartment, using the upper space 32 and the lower space 34 as a freezer compartment . In another example, the upper space 32 and the lower space 34 may be designed to be selectively used as one of a freezer or a refrigerating compartment and may be designed to be used for other purposes, as desired.

The door 20 may be provided as a swinging type door or a drawer moving forward and backward. In the present disclosure, the upper space 32 may include a swinging door 22, and the lower space 34 may include drawers 24 and 26.

In addition, the lower space 34 may be divided into two inner spaces, and the two drawers 24 and 26 may be positioned horizontally in the two spaces, respectively. For example, of the drawers 24 and 26, the drawer covering an upper space may be an upper drawer 24 and the drawer covering a lower space may be a lower drawer 26. The number of the doors may be variously changed depending on an inner space of the cabinet 10, and the doors may be provided as the swinging doors 22 or as the drawers 24 and 26.

The drawers 24 and 26 may be configured to be automatically moved forward or backward by an opening/closing device 100. As previously described, one or more of the drawers 24 and 26 may be configured to automatically move forward and backward. For example, each of the upper drawer 24 and the lower drawer 26 may be configured to automatically move forward and backward, or the upper drawer 24 may be configured to manually move forward and backward while the lower drawer 26 may be configured to automatically move forward and backward. For example, the upper drawer 24 may be configured to manually move forward and backward, and the lower drawer 26 may be automatically moved forward and backward by the opening/closing device 100.

In addition, one or more of the drawers 24, 26 may include a lift 200, which will be described hereinbelow, such that a container 40 provided therein may be automatically moved upward and downward. As previously described, the container 40 may be configured to be automatically moved upward and downward by the lift 200 when the drawer 24, 26 is removed from the storage space.

The opening/closing device 100 may have a rack-pinion structure and may apply a force that causes the drawer 26 to move forward and backward (e.g., to opposite sides of FIG. 2). For example, a rack 110 may be provided on a lower surface of the lower drawer 26, and the pinion 120 meshing with the rack 110 by gear engagement may be rotatably provided in a bottom surface of the refrigerator 1.

In addition, a motor 130 may be further provided on a bottom surface of the refrigerator 1 and may supply a rotational force to the pinion 120. For example, when the motor 130 generates the rotational force by using power supplied from the outside, the pinion 120 may be rotated clockwise or counterclockwise by the rotational force. For example, the lower drawer 26 combined with the rack 110 moves forward and backward (to the opposite sides of FIG. 2). In another example, the motor 130 is omitted and the pinion 120 is rotated based on, for example, a storage elastic force that is generated based on a user manipulation of the drawer 24, 26.

The rack 110 may be configured to be a double rack. For example, to allow the lower drawer 26 to be sufficiently opened to the outside, the rack 110 may be configured as a double rack having at least two racks. For example, the refrigerator 1 may include a button 50 or other mechanism to receive a user input to control the lower drawer 26 such that the lower drawer 26 may be automatically opened or closed. For example, as illustrated in FIG. 1, the button 50 may be provided on a front surface of a lower end of the swinging door 22 in the refrigerator 1, and the lower drawer 26 may be configured to be opened or closed by a user pressing the button. For example, the button 50 may be provided on a front surface of the lower drawer 26 or may be provided on various parts such as a front surface or side surface of the refrigerator 1.

The drawer 26 may include a storage bin 27 having a space the receive an item for storage or the container 40 therein and a front panel 28 provided at a front (e.g. a right side of FIG. 2) of the storage bin 27 to be integrated therewith so as to constitute an outer surface of a front of the drawer 26.

In addition, the refrigerator 1 may include a machine bin 60 provided at a lower rear side thereof. Various components, such as compressor and a condenser performing a refrigeration cycle, may be positioned in the machine bin 60.

Figure 3:
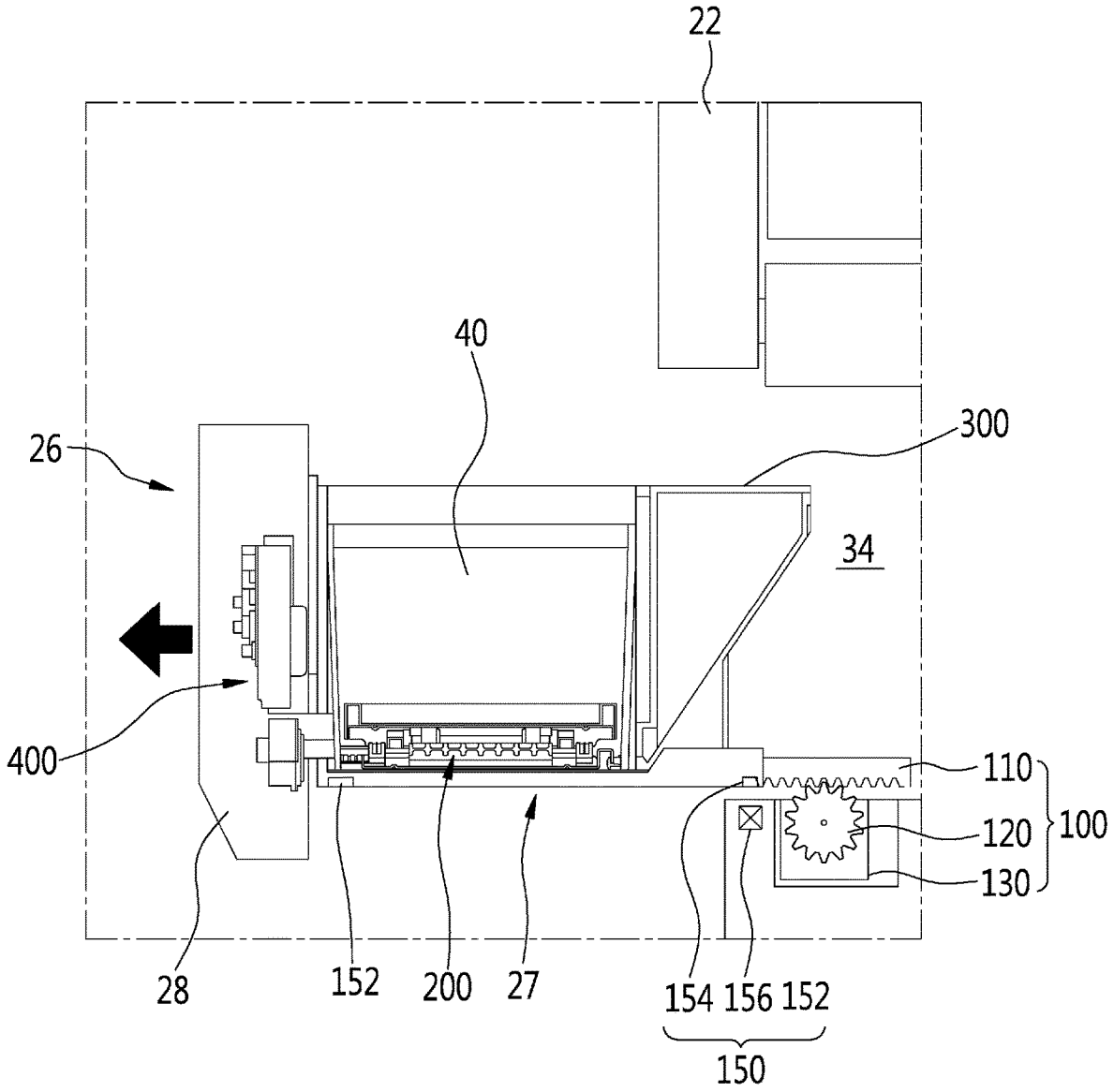
FIG. 3 is a partial sectional view illustrating a state of a lower drawer moved forward according to the present disclosure.
Figure 4:
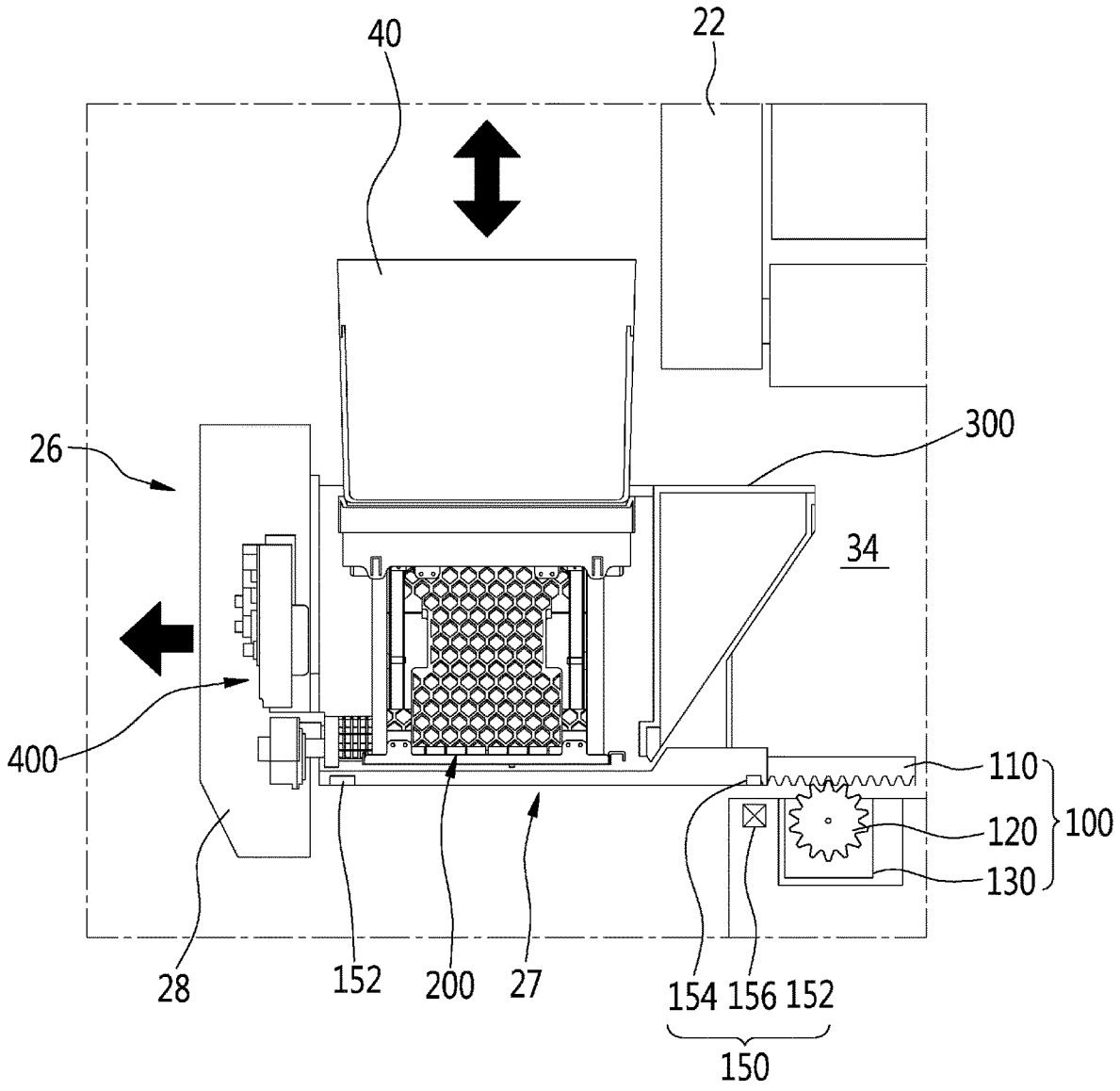
FIG. 4 is a partial sectional view illustrating a state of the container moved upward by the lift according to the present disclosure.

In FIGS. 3 and 4, a state of the lower drawer 26 of the drawers 24 and 26, when completely opened forward (to a left side of FIG. 3) is illustrated. For example, as illustrated in FIG. 3, the lower drawer 26 may be completely opened forward, and the lift 200 does not operate yet, and as illustrated in FIG. 4, while the lower drawer 26 may be completely opened forward, the container 40 may be moved upward by the lift 200.

As illustrated in these drawings, the lower drawer 26 may be moved forward (to a left side of FIGS. 3 and 4) by a forward moving control by the button 50. In this case, the forward movement of the lower drawer 26 may be performed by the opening/closing device 100. The lower drawer 26 may be not configured to be opened and closed by a manual manipulation of a user, but instead, the lower drawer 26 may be automatically opened and closed by a manipulation of a user pressing the button 50. For example, when a user presses the button 50, the rotational force may be generated by the motor 130, and the pinion 120 may be rotated counterclockwise by the rotational force. For example, when the pinion 120 rotates counterclockwise, the rack 110 meshing with the pinion 120 may be moved to the left, and the lower drawer 26 to which the rack 110 may be fixed moves to the left to be open.

A distance which the lower drawer 26 moves to be open to the left may be a length allowing the container 40 received into the storage bin 27 to be completely exposed to the outside from the front surface of the refrigerator 1. For example, the lower drawer 26 may be sufficiently opened such that a user may take out the container 40 or access items in the container 40.

In addition, the container 40 may be moved upward by the lift 200 provided at a lower side of the container 40. When the container 40 is being raised, the lower drawer 26 may be sufficiently opened such that the rising container 40 does not hit a surface of the refrigerator 1, such as a lower end of a front surface of the upper drawer 24. For example, to allow the lower drawer 26 to be sufficiently removed forward, the structure having the pinion 120 and the rack 110 may include the double rack structure, as previously described.

An open/close detecting mechanism 150 may determine whether the lower drawer 26 is sufficiently open (e.g., opened at least a threshold distance such that the container 40 may be vertically lifted without contacting a front surface of the refrigerator 1). The open/close detecting mechanism 150 may detect whether the lower drawer 26 is sufficiently open to the outside (the left side of FIG. 3) and may include permanent magnets 152 and 154, and a detection sensor 156.

The detection sensor 156 may be various sensors such as a Hall sensor or a lead switch. When the front end magnet 152 may be brought close to the detection sensor 156, the lower drawer 26 may be recognized to be closed, and when the rear end magnet 154 may be brought close to the detection sensor 156, the lower drawer 26 may be recognized to be opened.

The permanent magnets 152 and 154 may be fixed to a left end (e.g., a front end of the lower surface of the lower drawer) of the lower surface of the lower drawer 26 and a right end thereof (e.g., a rear end thereof), respectively, and the detection sensor 156 may be fixed to a front end part of the bottom surface of the refrigerator 1. For example, as illustrated in FIG. 3, the permanent magnets 152 and 154 may include a front end magnet 152 provided at the left end (the front end) of the lower surface of the lower drawer 26 and a rear end magnet 154 provided at the right end (the rear end) of the lower drawer 26.

The components of the open/close detecting mechanism 150 may be installed at other positions that differ from the above-described positions. For example, the permanent magnets 152 and 154 may be installed at the bottom surface of the refrigerator 1 and the detection sensor 156 may be installed at the lower drawer 26.

The container 40 may have a rectangular shape and an open upper part to be received in an inner space of the storage bin 27, and the container 40 may be configured to be moved upward and downward by the lift 200. For example, the lift 200 may be configured to be installed under the container 40 so as to support the container 40.

A rear side of the inner space of the storage bin 27 (right sides of FIGS. 3 and 4) may be covered by an inner cover 300. As illustrated in FIGS. 3 and 4, the inner cover 300 may be installed to have a section of an "L" shape as a whole and covers the remaining rear end space of the inner space of the storage bin 27 except for a space corresponding to an occupying space of the container 40 in the inner space thereof. For example, the rear end space of the storage bin 27 may be covered by the inner cover 300, such that the storage bin 27 has a neat appearance, and a hand of the user may be prevented from being trapped therein.

As illustrated in FIG. 3, when the forward movement of the lower drawer 26 is completed, then the lift 200 may operate and the container 40 may be moved upward. For example, the lift 200 positioned under the container 40 may operate to lift the container 40 to an upper side of the storage bin 27.

A driving device 400 may be provided in the front panel 28 of the lower drawer 26 and controls operation of the lift 200. For example, a vertical height of the lift 200 may be changed such that a distance between an upper surface and a lower surface of the lift increases or decreases. For example, the lift 200 may move the container 40 at an upper side thereof upward and downward, and the operation of the lift 200 may be controlled by the driving device 400.

The lift 200 may be configured to be folded or unfolded in an upper end and lower end thereof, and when the lift may be not used, volume thereof may be minimized, so the lift 200 may be received in the storage bin 27. For example, the lift 200 may be configured to have legs with a scissor-type link structure in which the height of the lift 200 may be minimized during the folding of the lift 200, and the height of the lift 200 may be maximized during the unfolding of the lift 200.

When the lift 200 is in folded state such that the container 40 is lowered when the lower drawer 26 is sufficiently removed from the storage chamber, the driving device 400 may operate to cause the folded links of the lift 200 to unfold. For example, an additional raising/lowering detection mechanism may be provided in the front panel 28, in the driving device 400, or in an area adjacent thereto and may detect whether the lift 200 is folded or unfolded. For example, a detected upward or downward moving position of the container 40 may provide an indication of the folding or unfolding state of the lift 200.

Figure 5:
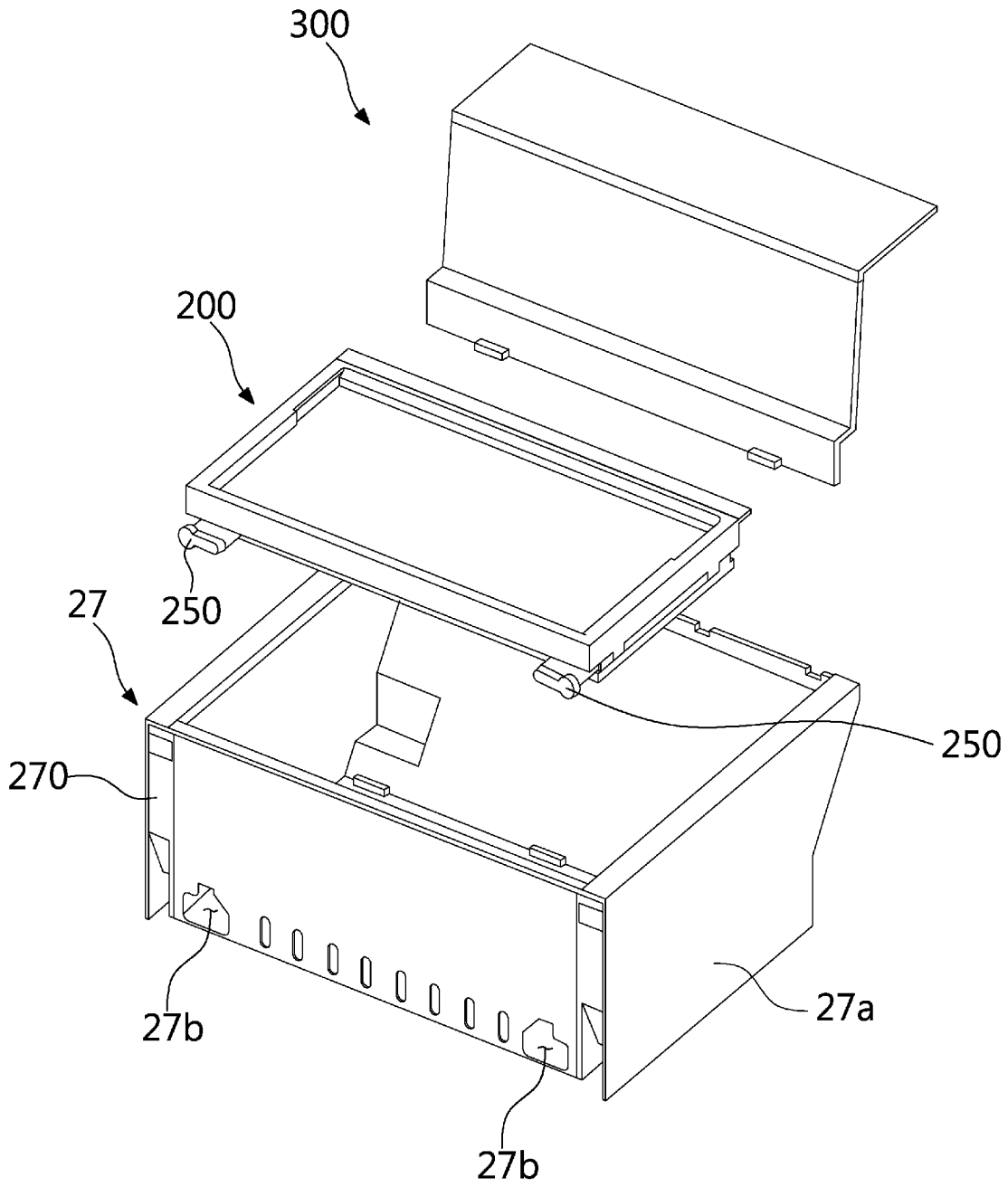
FIG. 5 is an exploded perspective view illustrating components of a storage bin of the lower drawer according to the present disclosure.
Figure 6:
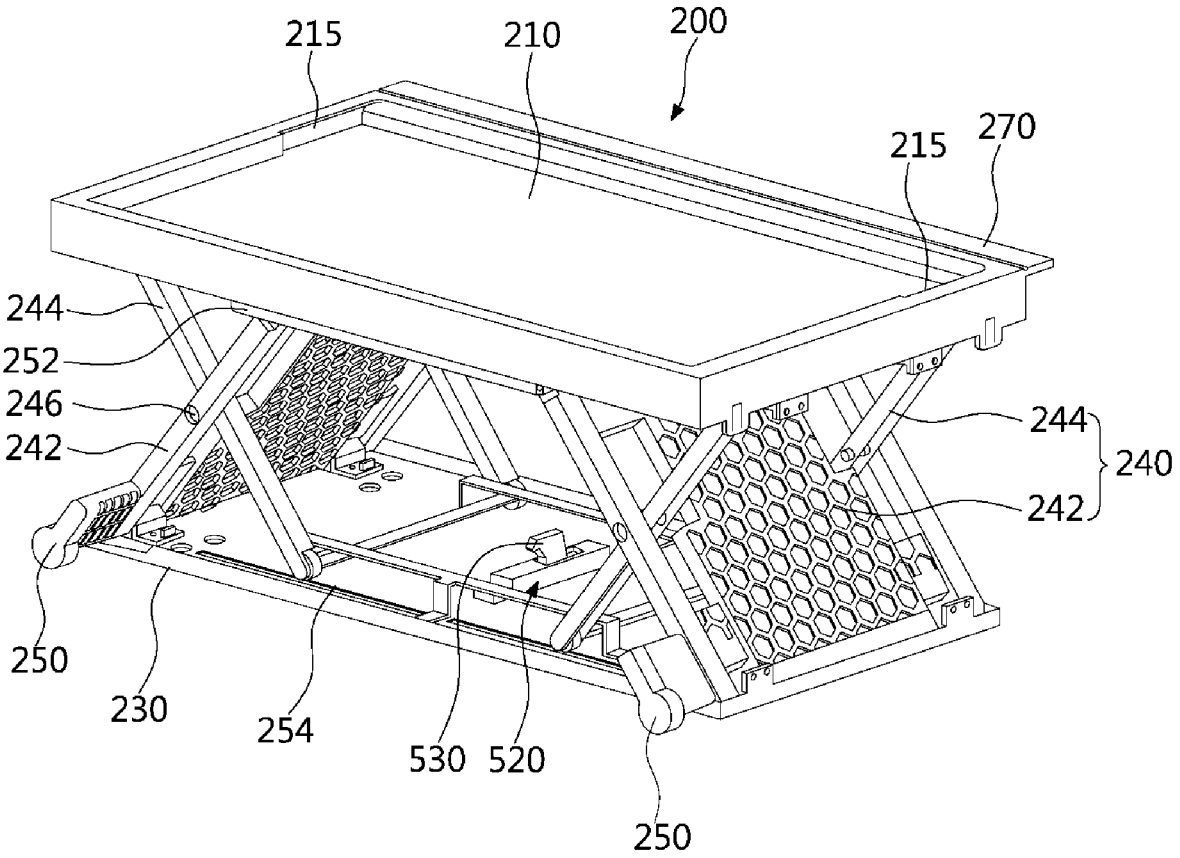
FIG. 6 is a perspective view illustrating configuration of the lift according to the present disclosure.
Figure 7:
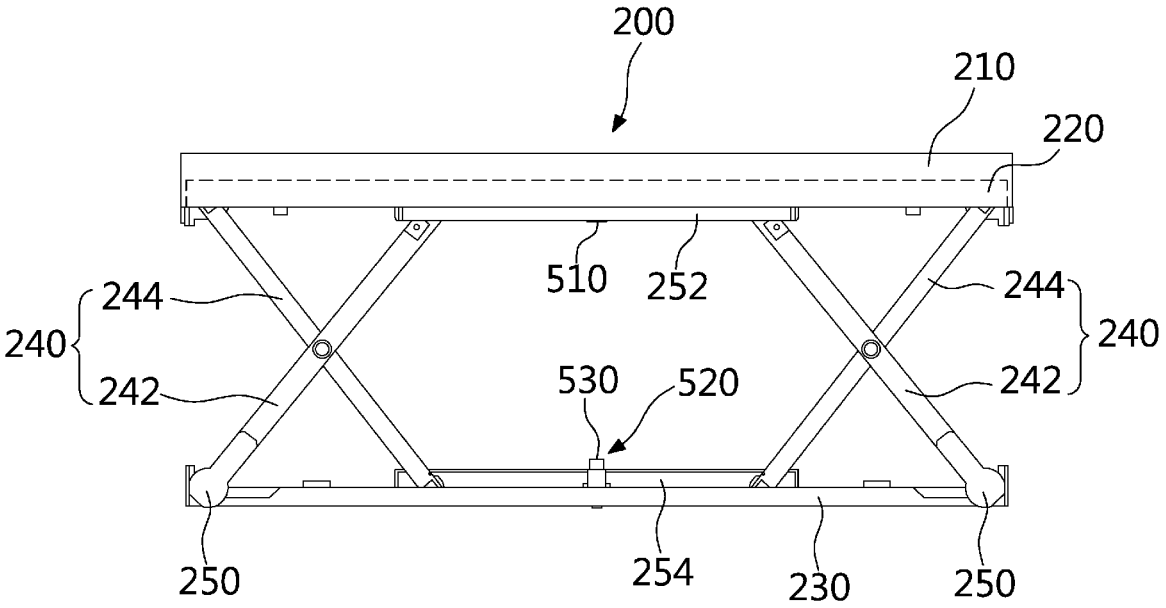
FIG. 7 is a front view illustrating the configuration of the lift according to the present disclosure.
Figure 8:
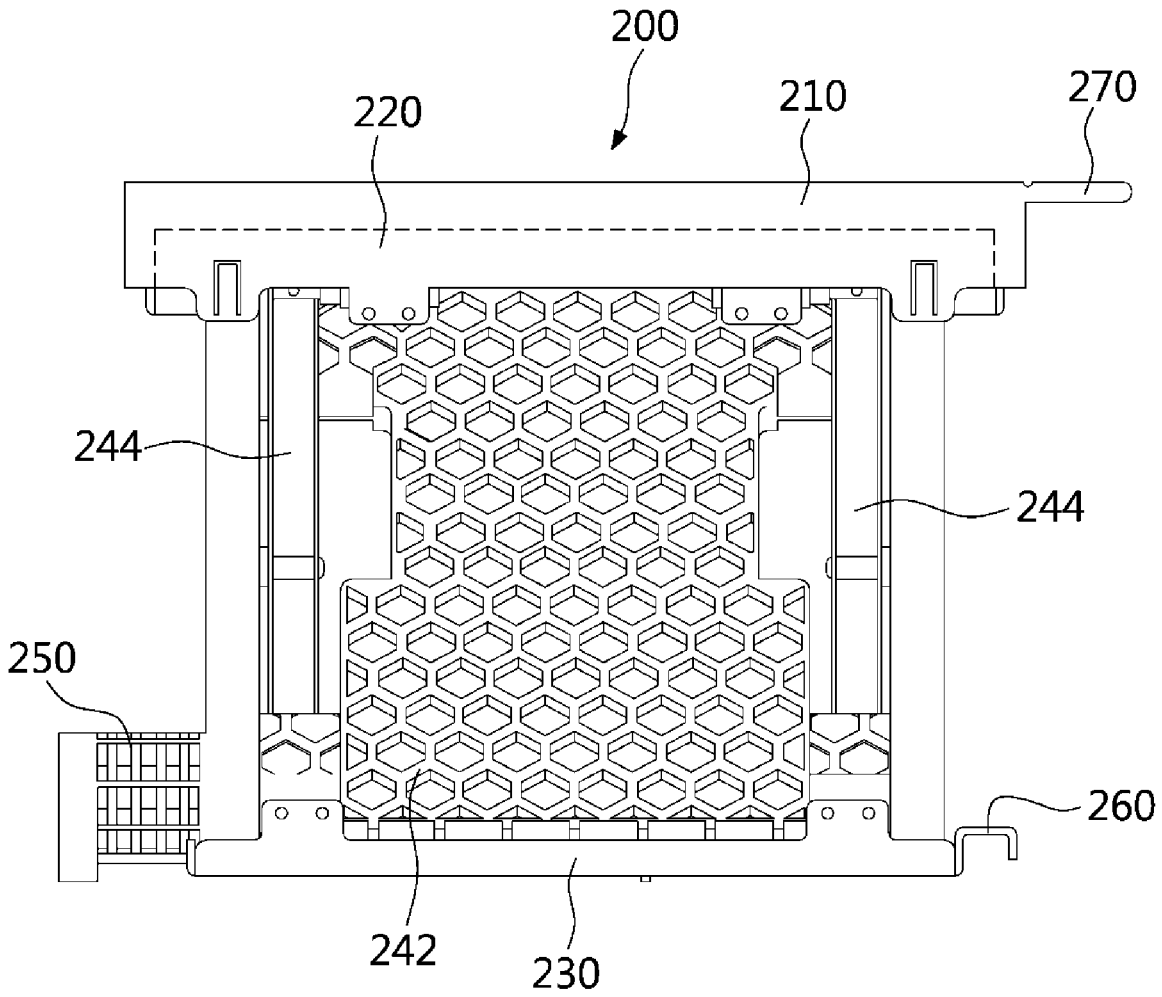
FIG. 8 is a right side view illustrating the configuration of the lift according to the present disclosure.
Figure 9:
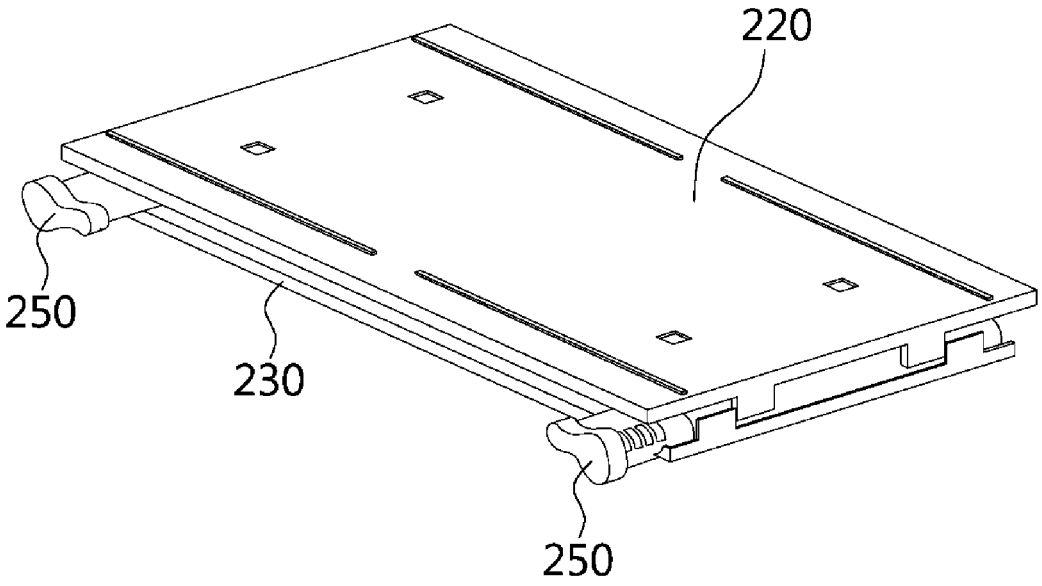
FIG. 9 is a perspective view illustrating configuration of a state of the lift from which a support plate is removed according to the present disclosure.

In FIG. 5, an exploded perspective view of components provided in the storage bin 27 is illustrated. As illustrated in FIG. 5, the storage bin 27 may be configured to have the containing space of a particular size therein so as to constitute an outer surface thereof. The storage bin 27 may include the lift 200 therein such that the container 40 or food may be moved upward and downward. In addition, the inner cover 300 may be further provided in the storage bin 27 so as to cover a rear end part of an inner part of the storage bin 27 and to partition the inner space of the storage bin 27.

The storage bin 27 may be formed of plastic materials by injection molding to have an entire shape thereof. The storage bin 27 may have a shape of a basket having an open upper surface to have a space therein to allow food to be stored. A rear surface of the storage bin 27 may be configured to be an inclined surface and the storage bin 27 may be prevented from being interfered with by the machine bin 60 provided at the lower rear side of the refrigerator 1 (e.g., in a space behind the inclined rear surface of the storage bin 27.

An outer side plate 27*a* may be further provided on each of opposite surfaces of outer sides of the storage bin 27. The outer side plate 27*a* may be installed on each of the opposite surfaces of the storage bin 27 to constitute outer surfaces thereof. Furthermore, the outer side plate 27*a* also functions such that components such as a door frame mounted to each of opposite sides of a drawer body 38 and the rack 110 constituting the opening/closing device 100 may be not exposed to the outside.

The inner cover 300 may divide the inner part of the storage bin 27 into a front space and a rear space. For example, the inner cover 300 covers the rear space of the inner space of the storage bin 27 so as to allow only the inner space of a front of the storage bin to be exposed to the outside. For example, in the inner part of the storage bin 27, only the front space at which the lift 200 may be arranged may be exposed to the outside and the rear space may be covered by the inner cover 300.

The inner cover 300 may be made of a metal material as the outer side plate 27*a*. This may be to allow a user to feel the texture of metal and create aesthetic qualities and have rigidity since the inner cover 300 may be a part seen during the forward movement of the lower drawer 26 by the user.

A front surface and side surfaces of the storage bin 27 may also be made of a metal material. For example, when each part of the storage bin 27 is made of the metal material, inner sides of the containing space of the storage bin 27 may entirely have the feel of metal, food stored therein may be stored to be entirely and evenly cold, and visually aesthetic qualities may be created for a user.

The lift 200 may sit or otherwise be positioned in the interior of the storage bin 27. The lift 200 has a structure of being vertically moved upward and downward by the driving device 400 connected thereto, which will be described, and opposite sides of the lift may move upward and downward.

To combine the lift 200 with the driving device 400, a connection hole 27*b* may be provided at each of lower opposite sides of the front surface of the storage bin 27 by being formed therethrough in a front to rear direction of the front surface. The connection hole 27*b* may be a part into which the scissor side connection part 250 provided at the front end of the lift 200 may be inserted to be received therein. For example, a radius of the connection hole 27*b* may be configured to be the same as or larger than a radius of the scissor side connection part 250.

In FIGS. 6 to 10, the configuration of the lift 200 may be illustrated. For example, in FIG. 6, a perspective view of configuration of the lift may be illustrated, and in FIGS. 7 and 8, a front view and a right side view of the lift 200 may be illustrated. In addition, in FIG. 9, a perspective view of a state of the lift 200 from which a support plate 210 may be removed may be illustrated, and in FIG. 10, a right side sectional view of the lift 200 may be illustrated. Furthermore, in FIG. 11, a side view of a state at which an upper fastener 510 may be automatically engaged with a lower fastener 520 due to lowering of an upper frame 220 of the lift 200 may be illustrated.

As illustrated in the drawings, the lift 200, which may be configured to be a scissor type, may be folded when the lift may be lowered and may be unfolded when the lift may be raised such that the container 40 or food seated on the upper surface thereof may be moved upward and downward. The lift 200 may be provided on an inner bottom of the storage bin 27 and may be removably provided at an inner side of the storage bin 27.

In addition, the lift 200 may be further include the support plate 210 thereon. For example, as illustrated in the accompanying drawings, the support plate 210 may be further provided on an upper end of the lift 200 to allow the container 40 laid on an upper side thereof to be efficiently seated. The support plate 210, which constitutes an outer surface of the upper surface of the lift 200, may be configured to have a particular thickness and may be made of a metal such as a stainless material to be aesthetic, and may be configured such that an inner part of the support plate may be depressed so as to allow the container 40 to be efficiently seated and fixed.

The lift 200 may include the upper frame 220 provided at the upper side thereof, a lower frame 230 provided under the upper frame 220, and a pair of legs 240 arranged between the upper frame 220 and the lower frame 230. As illustrated in the drawings, the upper frame 220 may be configured to have a rectangular frame shape, and the support plate 210 sits on and may be fixed to an upper surface of the upper frame 220.

The upper frame 220 of the lift 200 moves in upward and downward directions and substantially supports a stored item or the container 40 together with the support plate 210. The upper frame 220 may be configured to have a metal plate shape, and edges thereof may be partially bent downward. For example, the upper frame 220 may be configured to define a space to house each of the legs 240 in cooperation with the lower frame 230.

The lower frame 230 may be provided under the upper frame 220 and may sit on a bottom surface of the storage bin 27. Furthermore, the lower frame 230 may be configured to have a shape corresponding to a shape of the upper frame 220. The lower frame 230 may also be configured to have a metal plate shape as the upper frame 220, and edges thereof may be bent upward. For example, the lower frame 230 may be configured to define the space to house each of the legs 240 together with the upper frame 220.

The lift 200 may be configured to be unfolded or folded upward and downward by the legs 240. For example, to allow the lift 200 to be folded, a lock 500 may be included. The lock 500 allows the lower frame 230 and the upper frame 220 to be brought close to each other to vertically fold the lift 200 such that a vertical length of the lock may be minimized.

For example, the lock 500 may include the upper fastener 510 provided in the upper frame 220 and the lower fastener 520 provided in the lower frame 230.

The lower fastener 520 may be provided at a middle of the lower frame 230 and may allow the upper frame 220 and the lower frame 230 to be not inadvertently separated from each other and to restrict each other when the lift 200 is removed from the storage bin. For example, the lower fastener 520 allows the legs 240 to maintain the folded state thereof without unfolding.

Figure 10:
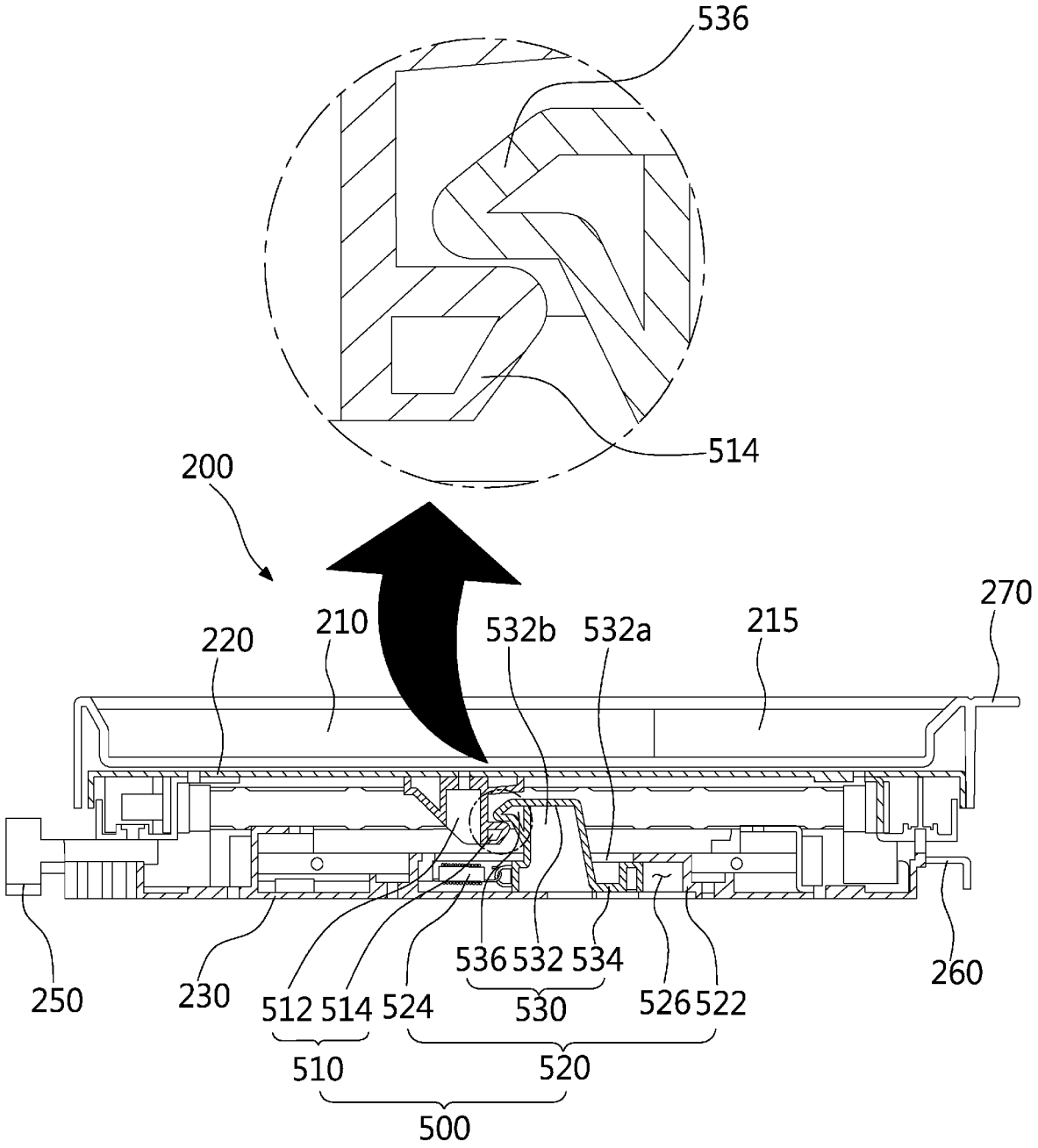
FIG. 10 is a right side sectional view illustrating the configuration of the lift according to the present disclosure.

The lower fastener 520 may include a locking mechanism casing 522 fixed to the middle of the lower frame 230, a lower hook 530 moving in the locking mechanism casing 522, and a spring 524 applying a unidirectional force to the lower hook 530. For example, the lower fastener 520 may be provided at the middle of an upper surface of the lower frame 230 by protruding upward therefrom. As illustrated in FIG. 10, the locking mechanism casing 522 may be configured to have a particular front to rear length (to opposite sides of FIG. 10) and a hook space 526 having volume of a particular size may be provided in the locking mechanism casing 522.

The lower hook 530 may include a lower hook body 532 having a particular vertical height, a support end 534 provided at a lower end of the lower hook body 532 to support the lower hook body 532, and a lower hook end 536 protruding by extending forward from an upper end of the lower hook body 532. The lower hook body 532 may be configured to have the particular vertical height and a hook hole 532*a* may be provided in an upper surface of the locking mechanism casing 522 by being vertically formed therethrough. For example, the hook hole 532*a* having a particular front to rear length may be provided in the upper surface of the locking mechanism casing 522 by being vertically formed therethrough, and the lower hook body 532 may be arranged by vertically passing through the hook hole 532*a*.

The lower hook body 532 may be configured such that an inner part thereof may be hollow and a lower part thereof may be open. For example, the inner part of the lower hook body 532 may be hollow and the lower part thereof may be open to have a protrusion groove 532*b*. A spacing protrusion 27*c*, which will be described hereinbelow, may be received in the protrusion groove 532*b*. For example, a front to rear thickness of the lower hook body 532 may be configured to gradually decrease toward the upper end of the lower hook body. For example, as illustrated in FIG. 10, at least a rear surface (a right surface of the lower hook body of FIG. 10) of the lower hook body 532 may be configured to be gradually inclined so as to be positioned at a further rear side toward a lower side thereof.

The front to rear length of the hook hole 532*a* may be configured to have a size larger than a size of the thickness of the lower hook body 532 provided to pass through the hook hole 532*a*. For example, the lower hook body 532 may be allowed to move a particular distance forward and backward while the lower hook body 532 may be received in the hook hole 532*a*.

As illustrated in FIG. 10, the support end 534 may be configured to extend forward and backward (to opposite sides of FIG. 10) at a lower end of the lower hook body 532 and vertically extend therefrom and may be a part moving forward and backward (to the opposite sides of FIG. 10) in the locking mechanism casing 522.

In addition, the support end 534 may be configured to sufficiently move forward and backward (to the opposite sides of FIG. 10) without having any interference occurring in the locking mechanism casing 522. For example, a width between the opposite sides of the support end 534 may be formed to be at least 0.5 mm smaller than a width between the opposite sides of the inner part of the locking mechanism casing 522.

The lower hook end 536 may be provided to protrude by a particular portion by perpendicularly bending to a front (a left side of FIG. 10) of the lower hook body 532 from the upper end thereof and has a shape corresponding to a shape of an upper hook end 514 of the upper fastener 510, which will be described hereinbelow. For example, a lower surface of the lower hook end 536 may be configured to be horizontal and a front surface thereof may be configured to be an inclined surface. For example, as illustrated in FIG. 10, the front surface of the lower hook end 536 may be configured to be the inclined surface, a height of which gradually decreases toward the front thereof.

The spring 524 may be provided in the locking mechanism casing 522 and functions to pull the lower hook 530 forward (to the left side of FIG. 10). More particularly, the spring 524 may be configured as a tension spring and functions to pull the lower hook 530 forward by tensile elasticity. A front of the spring 524 may be connected to a front surface of an inner side of the locking mechanism casing 522 and a rear end of the spring may be connected to a front end of the support end 534.

The spring 524 may be made of various materials such that the spring has function of pushing or pulling the lower hook 530 forward by the elasticity. For example, the spring 524 may be provided as an elastic spring and installed at a rear side of the support end 534 to push the lower hook 530 forward by an elastic force.

The upper frame 220 may include the upper fastener 510 provided on a middle portion of a lower surface of the upper frame. As illustrated in the accompanying drawings, the upper fastener 510 may be provided by protruding downward from the lower surface of the upper frame 220 and has a shape corresponding to a shape of the lower hook 530 such that the upper fastener and the lower hook may be engaged with each other.

In certain configurations, the shape of the upper fastener 510 may be formed to be symmetrical to the shape of the lower hook 530, and may include an upper hook body 512, which may be a body of the upper fastener, and the upper hook end 514 provided by perpendicularly bending from a lower end of the upper hook body 512 to a rear side thereof (a right side of FIG. 10).

For example, when the upper hook end 514 of the upper fastener 510 couples the lower hook end 536 of the lower hook 530 (See FIG. 10), the lift 200 becomes folded (e.g., locked in a folded, closed positioned). For example, an upper surface of the upper hook end 514 may be formed horizontally and a rear surface thereof may be provided to be an inclined surface. For example, as illustrated in FIG. 10, the rear surface of the upper hook end 514 may be configured to gradually incline upward toward a rear thereof.

For example, when the front surface of the lower hook end 536 and the rear surface of the upper hook end 514 are configured as inclined surfaces to be in parallel with each other and the lower surface of the lower hook end 536 and the upper surface of the upper hook end 514 are configured to be horizontal, the lower hook end 536 with the upper hook end 514 may engage each other without inadvertently loosening of the engagement. For example, as illustrated in FIG. 10, when the lower hook end 536 and the upper hook end 514 engage each other, each of the horizontal surfaces thereof may be in contact with each other. The engagement of the lower hook end 536 with the upper hook end 514 may be maintained even when the pulling force is vertically applied thereto.

Figure 11:
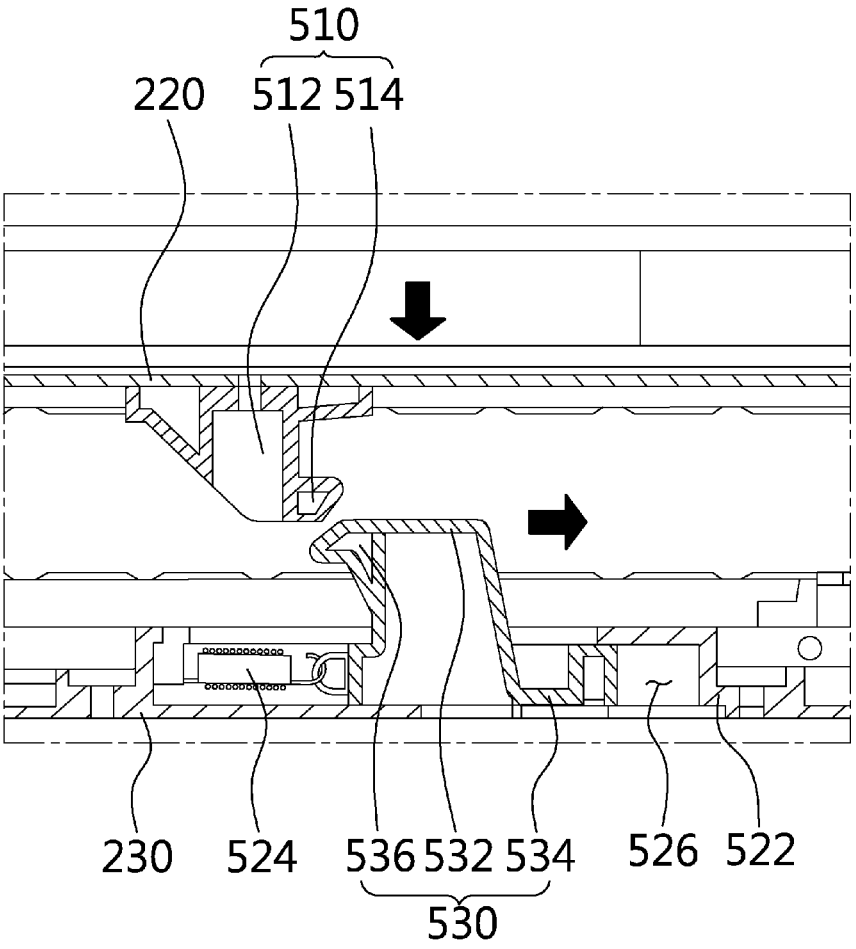
FIG. 11 is a side view illustrating a state at which an upper fastener is automatically engaged with a lower fastener due to lowering of an upper frame of the lift according to the present disclosure.

On the other hand, as illustrated in FIG. 11, when the upper frame 220 of the lift 200 lowers, the upper fastener 510 and the lower fastener 520 may be automatically engaged with each other. For example, since the spring 524 pulls the lower hook 530 forward (e.g., to a left side of FIG. 11) by the elasticity of the spring, the upper hook end 514 and the front surface (the inclined surface) of the lower hook end 536 may contact with each other when the upper hook end 514 gradually lowers and contacts with the lower hook end 536. For example, the lower hook end 536 may be pushed backward (a right side of FIG. 11) and may be automatically engaged with the upper hook end 514 as illustrated in FIG. 10.

The spring 524 may be provided in the locking mechanism casing 522 and may pull the lower hook 530 forward (to the left side of FIG. 10). For example, the spring 524 may be configured as the tension spring and functions to pull the lower hook 530 forward by the tensile elasticity.

In one example, the lift 200 may freely fold and unfold when in the bin 300, but when the lift 200 may be removed upward from the storage bin, the lift 200 may be maintained in folded state. For example, the lift 200 may unfold when the container 40 sits on an upper side of the lift 200 to be moved upward and downward, and when the lift 200 is removed to the outside of the storage bin (e.g., not supporting the container 40) the lift 200 may be locked to remain folded.

For example, the anti-loosening device may be further provided to allow the lift 200 to rotate relative to the front end thereof such that the folded state of the lift 200 may be maintained when the lift 200 is removed from the storage bin. Such an anti-loosening device may include the lock 500 preventing the lift 200 from unfolding and a handle 215, which will be described hereinbelow. For example, apart from the lock 500, the handle 215 configured to be held by a user may be provided at each of rear end parts of opposite side edges of the lift 200 so as to allow the lift 200 to rotate relative to the front end thereof.

For example, when a user holds and lifts the handle 215 provided at the rear end part of the lift 200, the lift 200 may be naturally rotated relative to the front end thereof. For example, the lower fastener 520 escapes from the spacing protrusion 27*c*, which will be described hereinbelow, and the folded state of the lift 200 may be maintained by the lock 500.

The legs 240 may be provided at opposite sides of the upper frame 220 and the lower frame 230 relative to a middle of each of the upper frame and the lower frame. For example, each of the legs 240 may be axially coupled to the upper frame 220 and the lower frame 230. For example, the upper frame 220 may move upward and downward according to the movement of the legs 240.

Each of the pair of legs 240 provided at the opposite sides may be different only in an installation position and may be similar in terms of a structure and shape thereof. For example, as illustrated in the accompanying drawings, the distance between the upper frame 220 and the lower frame 230 may be decreased or increased by the movement of the legs 240 having an "X" shape as a whole at each of the opposite sides.

The legs 240 may include a plate-shaped plate unit 242 and a rod unit 244 axially coupled to intersect with the plate unit 242. For example, the plate unit 242 may be rotatably mounted to the lower frame 230. For example, the plate unit 242 may be rotatably installed at each of opposite ends of the lower frame 230. The rod unit 244 may be rotatably connected to the upper frame 220. For example, For example, the rod unit 244 may be rotatably installed at each of opposite ends of the upper frame 220.

The plate unit 242 may be configured to be a rectangular plate shape and be made of aluminum alloy materials. For example, the plate unit may be formed to have high rigidity and be light, and may also be formed by die casting. The plate unit 242 may include the scissor side connection part 250 provided at a lower end thereof by protruding therefrom. For example, the scissor side connection part 250 may be provided at a front end of the plate unit 242 by further protruding forward to be integrated with the plate unit.

The rod unit 244 may be installed to intersect the plate unit 242. For example, the rod unit 244 and the plate unit 242 unfold to have an "X" shape (as viewed from a front thereof) by intersecting each other, and an intersecting shaft 246 may be provided at a center portion at which the rod unit 244 and the plate unit 242 intersect each other such that the rod unit 244 and the plate unit 242 rotatably intersect each other.

Ends of the rod unit 244 and the plate unit 242 may be in contact with the lower surface of the upper frame 220 and the upper surface of the lower frame 230 and For example, the rod unit 244 and the plate unit 242 may be configured to slidably move. For example, a lower end (in FIG. 6) of the plate unit 242 may be rotatably mounted to the lower frame 230 and an upper end of the plate unit 242 may be installed on the lower surface of the upper frame 220 to slidably move. For example, an upper moving guide 252 may be provided on the lower surface of the upper frame 220 to have a particular length to opposite sides thereof and may be in contact with the upper end of the plate unit 242 to guide the plate unit such that the plate unit slidably moves. For example, a roller rotating along the upper moving guide 252 may be further provided at the upper end of the plate unit 242.

An upper end (in FIG. 6) of the rod unit 244 may be rotatably mounted to each of the opposite ends of the upper frame 220, and a lower end of the rod unit 244 may be slidably installed on the upper surface of the lower frame 230. For example, a lower moving guide 254 may be installed on the upper surface of the lower frame 230 to have a particular length to opposite sides thereof and may be in contact with the lower end of the rod unit 244 so as to guide a sliding movement of the rod unit. A roller rotating along the lower moving guide 254 may be further provided at the lower end of the rod unit 244.

A rear end hook 260 of a hook shape may be further provided at a rear end (a right end of FIGS. 8 and 10) of the lower frame 230 by extending backward, and a cover piece 270 may be provided at a rear end of the support plate 210 by extending backward therefrom to prevent a user's finger being trapped. The rear end hook 260 may be held by a lower end of the inner cover 300 and the cover piece 270 covers a gap between the lift 200 and the inner cover 300. In addition, the handle 215, which will be described hereinbelow, may be provided at each of rear end parts of the opposite side edges of the support plate 210.

Figure 12:
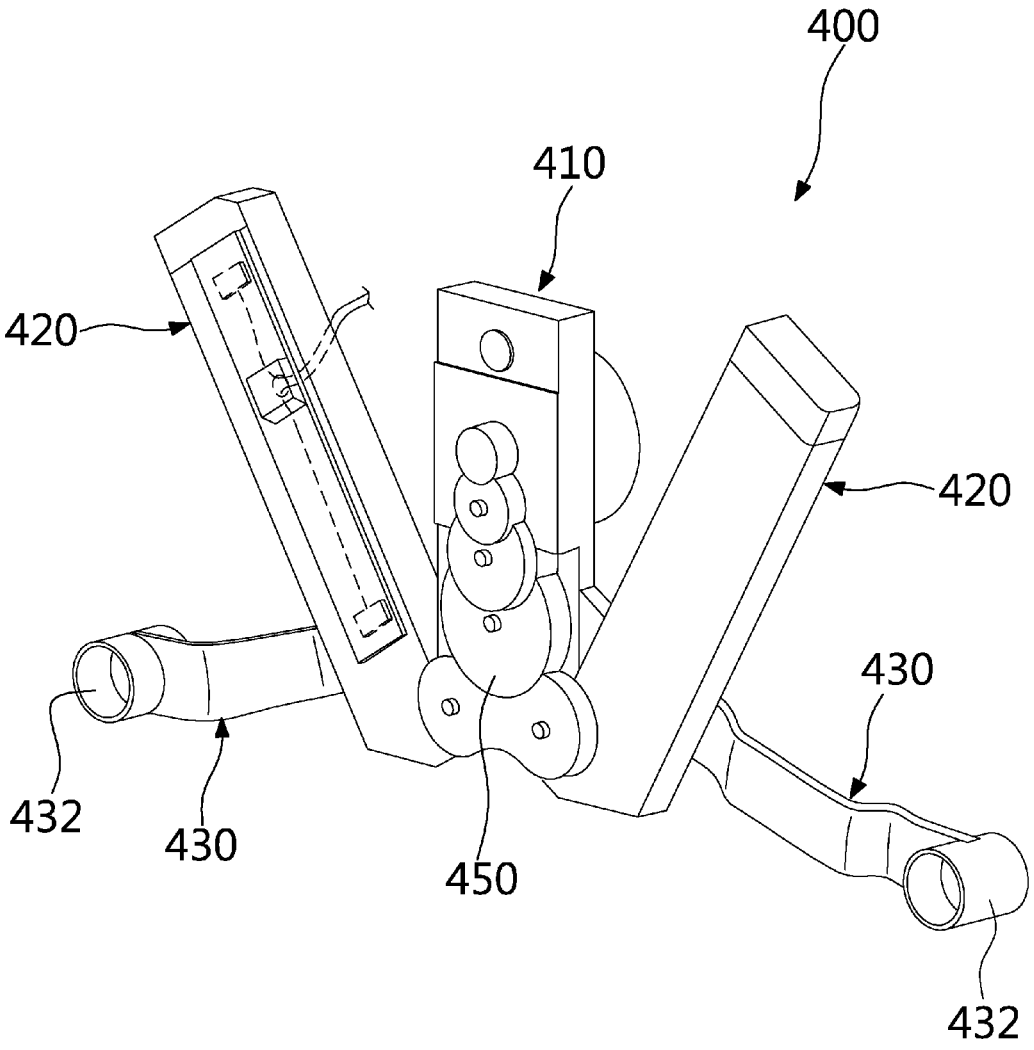
FIG. 12 is a perspective view illustrating configuration of a driving device according to the present disclosure.
Figure 13:
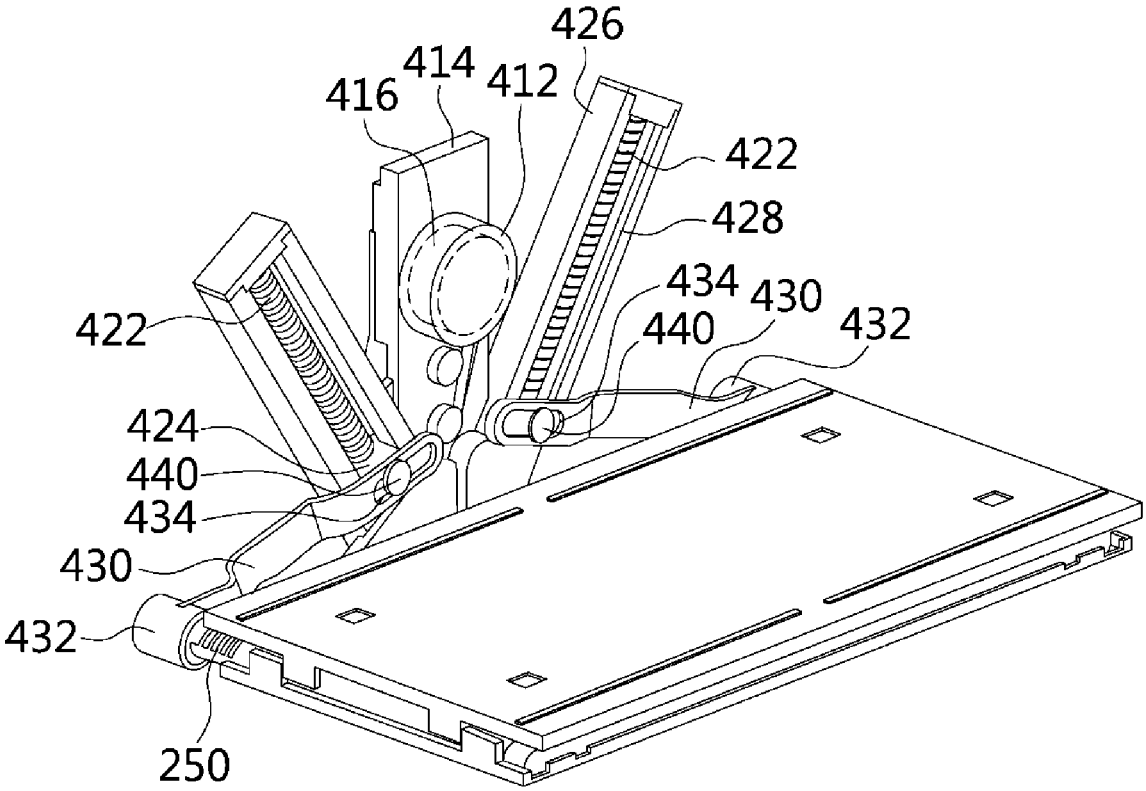
FIG. 13 is a rear perspective view illustrating the configuration of each of the driving device and the lift according to the present disclosure.
Figure 14:
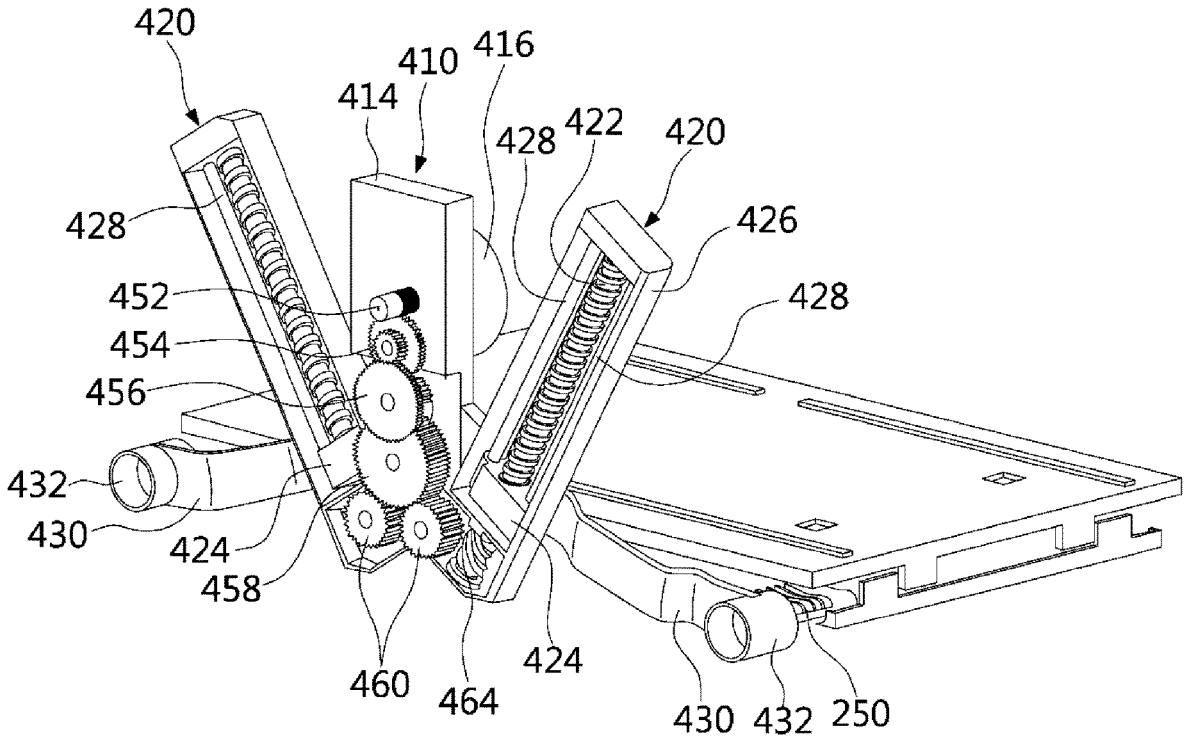
FIG. 14 is a front perspective view illustrating the configuration of each of the driving device and the lift according to the present disclosure.

FIG. 12 may be a perspective view illustrating configuration of a driving device 400, and FIGS. 13 and 14 may be a rear perspective view and a front perspective view, respectively, illustrating a state at which the driving device 400 and the lift 200 may be connected to each other. As illustrated in these drawings, the driving device 400 may be arranged in the front panel 28 and may be connected to the lift 200 provided at a rear side thereof. For example, power generated by the driving device 400 may be transmitted to the lift 200.

The driving device 400 may transmit power simultaneously to the opposite sides of the lift 200. For example, the lift 200 may move upward and downward in parallel in the opposite sides thereof without slanting.

The driving device 400 may include a motor assembly 410, a screw unit 420 arranged at each of opposite sides of the motor assembly 410 to have a pair of screw units, and a lever 430 connected to each of the screw units 420 to have a pair of levers. In addition, the screw unit 420 may include a screw 422 and the screw holder 424, through which the screw 422 passes, moving upward and downward along the screw 422.

A lever connection part 432 may be provided at an end of the lever 430 and the lever connection part 432 may be rotatably fixed to a rear surface of the front panel 28. The lever connection part 432 may be combined with the scissor side connection part 250.

A lever hole 434, into which a holder engaging member 440 may be locked, may be provided in an inner end of each of the pair of the levers 430. The lever hole 434, which may be configured to be a longitudinal hole, guides movement of the holder engaging member 440 and at the same time allows the holder engaging member 440 to be engaged with the screw holder 424. For example, the lever 430 may be rotated by the screw holder 424 moving upward and downward during rotation of the screw 422.

The motor assembly 410 may be positioned at a middle portion of the front panel 28. A drive motor 412 may be provided in the motor assembly 410 and the screw units 420 and the levers 430 of the opposite sides of the motor assembly 410 may be operated by the motor assembly 410 including the drive motor 412.

The motor assembly 410 allows speed reduction and a magnitude of a transmitted force to be adjusted by combination of multiple gears. In addition, the motor assembly 410 has a structure of having the drive motor 412 and the gears vertically arranged so as to minimize a recessed space of the front panel when the motor assembly 410 may be installed in the front panel 28. Particularly, to minimize a thickness of the motor assembly 410, a width of opposite side directions thereof may be configured to be wide and a thickness of forward and backward directions thereof may be configured to be minimized. In addition, the drive motor 412 in the motor assembly 410 may toward the storage bin 27 so as to allow a recessed depth of the front panel 28 to be minimized such that a thermal insulation performance of the front panel may be guaranteed.

The drive motor 412 provides power to the lift 200 such that the lift 200 may be moved upward and downward and may be configured to rotate clockwise/counterclockwise. For example, when an upward or downward moving signal of the lift 200 is input, the drive motor 412 rotates clockwise or counterclockwise and provides power to the lift 200 so that the lift may be moved upward and downward. Furthermore, the drive motor 412 may be stopped at the input of a stop signal by a load thereof or detection of a sensor.

The motor assembly 410 may include the drive motor 412, a motor casing 414 in which the drive motor 412 may be installed, and a motor cover 416 with which the motor casing 414 may be combined and covers the drive motor 412. A rotating shaft of the drive motor 412 may protrude from the motor casing 414 toward a side opposite to a side of the motor cover 416. Furthermore, the motor assembly 410 may further include a power transmission part to transmit the power of the drive motor 412.

The power transmission part may be positioned at a side opposite to a side of the drive motor 412 relative to the motor casing 414. The power transmission part may be configured by the combination of the multiple gears and may be covered by a cover member 450 mounted at a side (a front of the motor casing) opposite to the side of the drive motor 412.

The power transmission part may include a drive gear 452 connected to the shaft of the drive motor 412 passing through the motor casing 414, a first transmission gear 454 provided at a lower side of the drive gear 452 to mesh therewith, a second transmission gear 456 meshing with the first transmission gear 454, a third transmission gear 458 meshing with the second transmission gear 456, and a pair of cross gears 460 meshing with the third transmission gear 458. In addition, as illustrated in FIG. 14, the second transmission gear 456 meshing with the first transmission gear 454 may be configured as a multi-stage gear to mesh with the upper and lower gears each other.

The cross gears 460 may be configured to may include spur gears and helical gears. For example, a first helical gear part may be provided at a rear of each of the cross gears 460 configured to have a spur gear shape, and the first helical gear part meshes with a second helical gear part 464 of a side of each of the cross gears.

A rotation center line of the second helical gear part 464 may be arranged to intersect a rotation center line of the cross gear 460. For example, the first helical gear part and the second helical gear part 464 may be combined with each other in a state intersecting with each other and may be configured to be engaged with each other so as to allow rotations thereof to be transmitted to each other.

The rotation center line of the cross gear 460 extends in a front to rear direction thereof and the rotation center line of the second helical gear part 464 extends in an inclined vertical direction. Furthermore, as illustrated in FIG. 14, each of the rotation center lines of the second helical gear parts 464 arranged at the opposite sides of the cross gears may be arranged to be inclined in a direction gradually moving away from each other upward.

The screw unit 420 may be positioned at each of the opposite sides of the motor assembly 410. The screw unit 420 may be positioned at each of the opposite sides of an inner side of the front panel 28 and each of the pair of the screw units 420 may be different only in an installation position thereof, but may be the same in a structure and shape thereof.

The power of the drive motor 412 may be transmitted to a lower part of the screw unit 420. Each of the screw units 420 of the opposite sides may be configured to be symmetrical to each other relative to the motor assembly 410. For example, the motor assembly 410 may be arranged between the screw units 420 positioned at the opposite sides, and each of the screw units 420 arranged at the opposite sides may be arranged to have a shorter distance therebetween toward a lower end thereof from an upper end thereof.

The screw unit 420 may include the screw 422 rotated by receiving the power of the drive motor 412, wherein the screw 422 extends in upward and downward directions and may be configured to be inclined such that an upper end thereof faces an outside thereof and a lower end thereof faces an inside thereof. The screw 422 may be connected to the second helical gear part 464. For example, the screw 422 rotates together with the second helical gear part 464 during rotation thereof.

The screw unit 420 may be further include the screw holder 424 through which the screw 422 passes to be combined therewith, wherein the screw holder 424 moves upward and downward along the screw 422 during rotation of the screw 422. In addition, since the lever 430 may be combined with the screw holder 424, the lever 430 rotates during movement of the screw holder 424. For example, during the rotation of the screw 422, the screw holder 424 moves along the screw 422.

In addition, a magnet may be provided in the screw holder 424. The magnet may be provided such that a position of the screw holder 424 may be detected and when the screw holder 424 may be positioned at a lowest end or a top end of the screw 422, the raising/lowering detection mechanism detects this. For example, completion of an upward or downward movement of the lift can be determined by whether the magnet installed in the screw holder 424 may be detected.

The lever 430 connects the screw holder 424 with the lift 200 and each of opposite sides of the lever may be combined with each of the screw holder 424 and the lift 200.

The screw unit 420 may further include a housing 426 receiving the screw unit 420. The housing 426 constitutes an outer surface of the screw unit 420 and may include a space in which the screw unit 420 and the screw holder 424 may be received.

The housing 426 may be formed by bending a plate shaped metal material or may be formed of a plastic material. The housing 426 may include at least one guide bar 428 to guide lifting of the screw holder 424. The at least one guide bar 428 may extend in parallel with the screw 422 while being spaced apart from the screw 422. A plurality of guide bars 428 may be provided in the housing 426 such that the screw holder 424 may be not displaced to any side of a left or right side relative to the screw 422, and the screw 422 may be positioned between the plurality of guide bars 428.

The motor casing 414 and a pair of housings 426 may be provided to be integrated with each other. Furthermore, a single cover member 450 may cover the motor casing 414 and the pair of housings 426. For example, the cover member 450 may be combined with the motor casing 414 to cover the power transmission part, and may be combined with the pair of housings 426 to cover the screw 422, the guide bars 428, and the screw holder 424.

Since the driving device 400 is provided as a module, the driving device 400 may be relatively compact, and the driving device 400 may be installed in the front panel 28.

Figure 15:
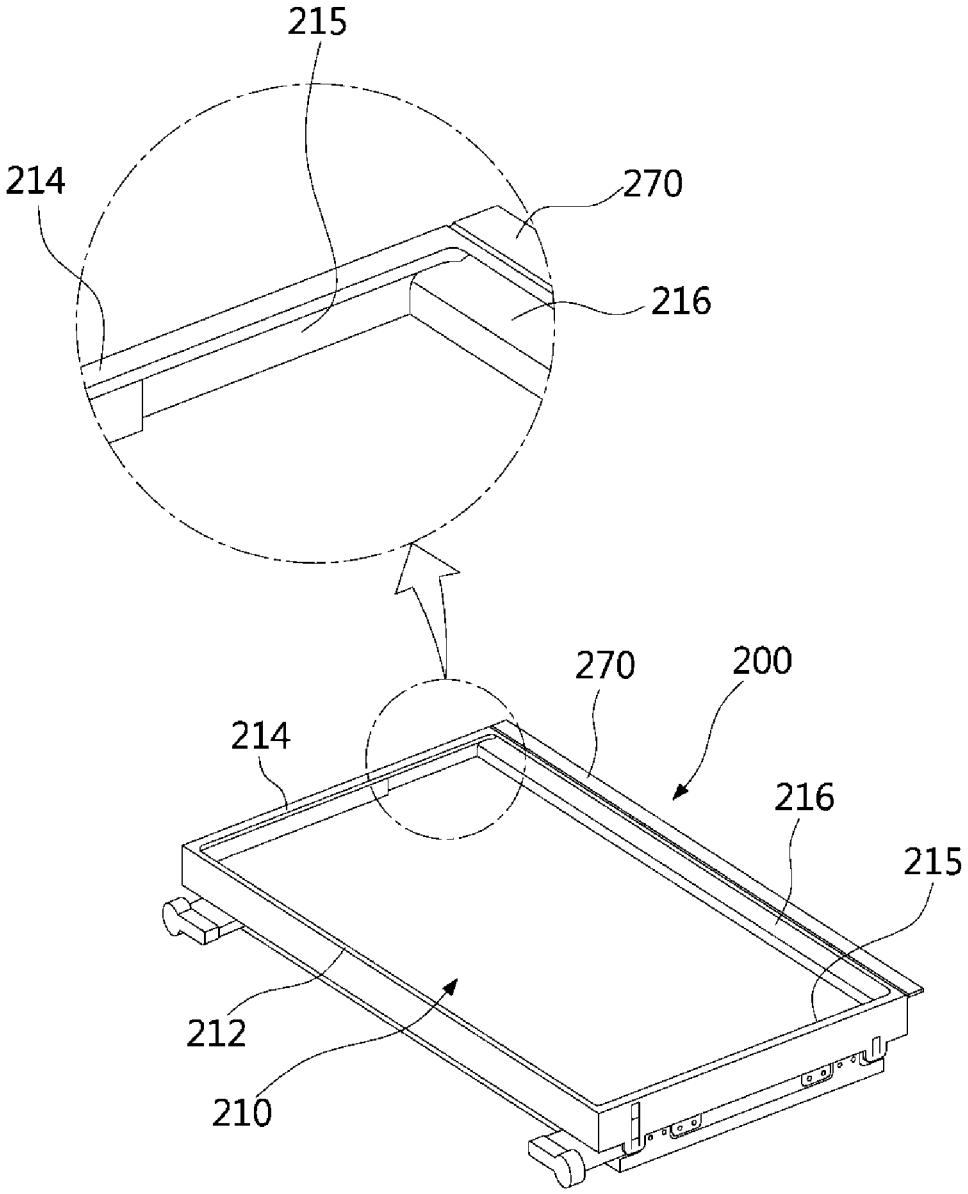
FIG. 15 is a perspective view illustrating a state of the lift folded according to the present disclosure.

FIG. 15 may be a perspective view of a state of the lift folded according to the present disclosure. As illustrated in FIG. 15, the support plate 210 may form an upper outer surface of the lift 200. In addition, the support plate 210 may be a rectangular flat plate as a whole, and each of edges thereof protrudes upward to have a particular height. For example, the upper surface of the support plate 210 may be entirely formed such that an inner part of each of the edges thereof may be depressed, so that a lower end of the container 40 may be easily seated.

The edges of the support plate 210 may include a front edge 212 provided by protruding upward from an upper surface of a front end thereof, side edges 214 provided by protruding upward from opposite sides thereof, and a rear edge 216 provided by protruding upward from an upper surface of a rear end thereof.

An upper end of the rear edge 216 may extend backward to have the cover piece 270, and as described above, the cover piece 270 covers the gap between the lift 200 and the inner cover 300 such that fingers of a user or a child may be prevented from being trapped in the gap.

Each of the side edges 214 may be further include the handle 215 at the rear end part thereof. The handle 215 may be a part held by fingers of a user when the user takes out the lift 200 from the inner part of the storage bin 27.

As illustrated in the drawings, the handle 215 may be configured to be recessed from an inner surface of each of the pair of the opposite side edges 214 to an outer side thereof. For example, a user may move his/her fingers from a middle of the upper surface of the support plate 210 to each of the pair of side edges 214, put his/her fingers in the recessed portion of the handle 215, and lift the lift 200 upward from the drawer 26. For example, the lift 200 may rotate relative to the front end thereof and the rear end part thereof may be lifted upward.

Figure 16:
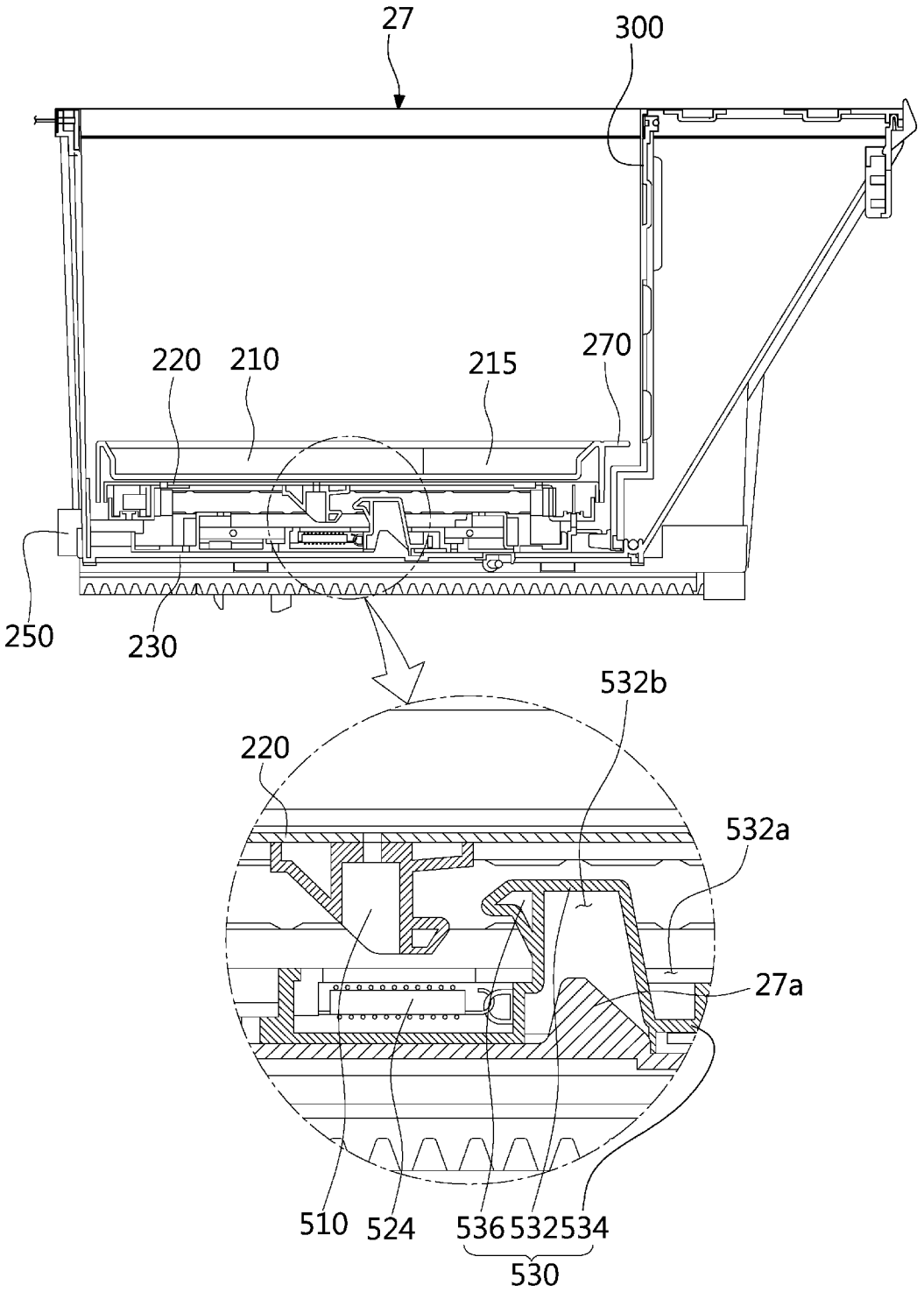
FIG. 16 is a sectional view illustrating a state of the lift mounted in the storage bin according to the present disclosure.
Figure 17:
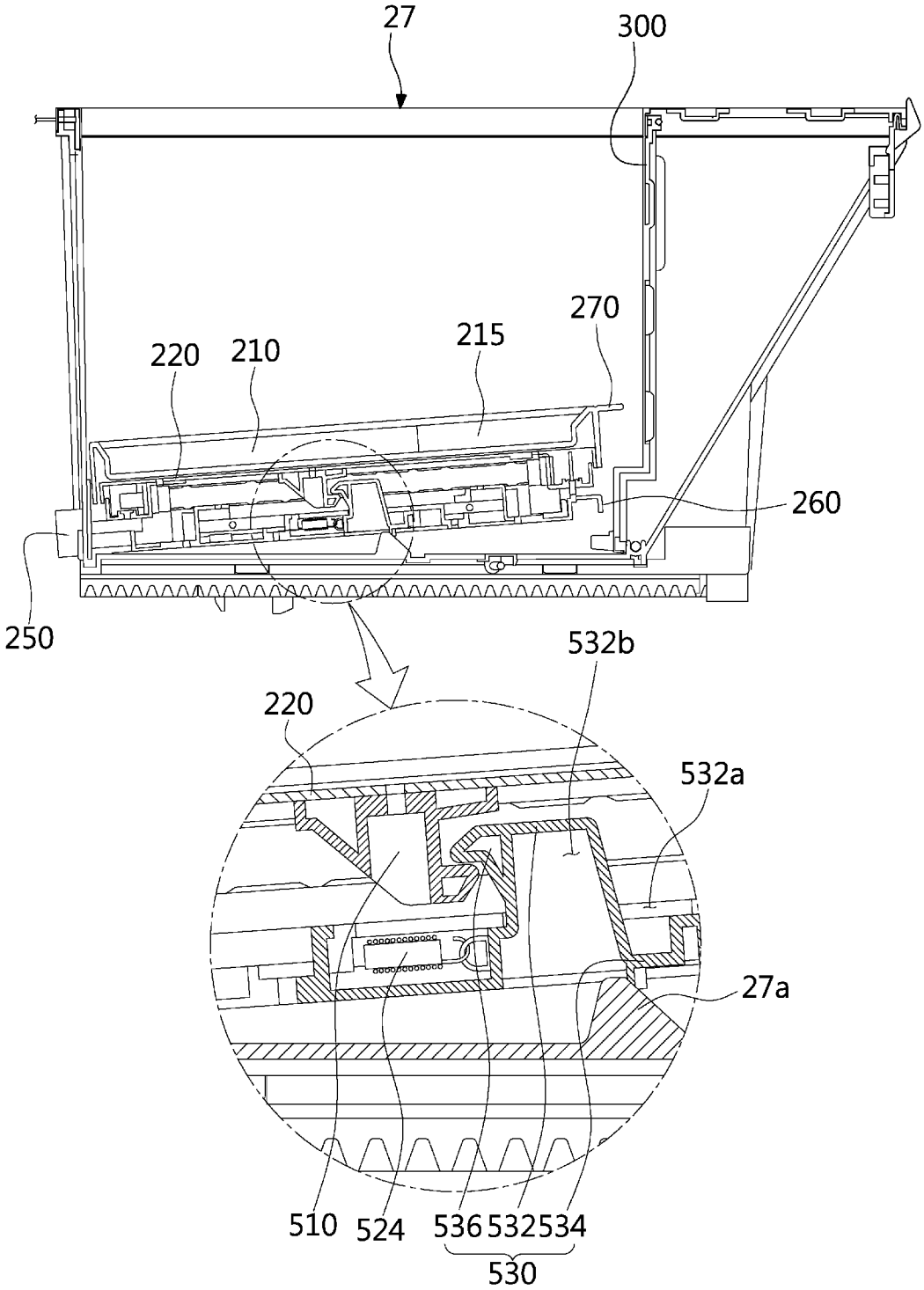
FIG. 17 is a partial sectional view illustrating a state of the lift lifted upward while being mounted in the storage bin according to the present disclosure.

FIG. 16 may be a sectional view of a state of the lift 200 mounted in the storage bin 27, and FIG. 17 may be a partial sectional view illustrating a state at which the lift 200 mounted in the storage bin 27 may be lifted upward. As illustrated in FIG. 16, the lift 200 sits on the bottom surface of the inner part of the storage bin 27. In this case, the scissor side connection part 250 of the lift 200 passes through the connection hole 27*b* of the storage bin 27 and For example, a front end of the scissor side connection part 250 may protrude to the front (a left side of FIG. 16) of the storage bin 27.

In addition, the lower hook 530 may move backward (e.g., a right side of FIG. 16) and may be separated from the upper fastener 510. For example, the upper frame 220 and the lower frame 230 may be not locked to each other in the folded state. In this example, the storage bin 27 may include the spacing protrusion 27*c* provided at a middle part thereof by protruding upward therefrom, and the lower hook 530 may be moved backward (the right side of FIG. 16) by the spacing protrusion 27*c*.

As illustrated in FIG. 16, the spacing protrusion 27*c* may be configured to have a "Δ" (triangular) shape having a pointed upper side. Although a front surface (a left-side surface of FIG. 16) of the spacing protrusion 27*c* may be vertically configured, a rear surface thereof (a right-side surface of FIG. 16) may be slanted.

This shape may allow a rear end part of the protrusion groove 532*b* of the lower hook 530 to be in a sliding contact with the rear surface of the spacing protrusion 27*c*. For example, the upper fastener 510 and the lower hook 530 of the lift 200 may be engaged with each other to maintain the folded state thereof outside of the storage bin 27. For example, when the lift 200 of the folded state may be installed on the bottom surface from an upper part of the storage bin 27, the lift 200 may be brought into a close contact with the bottom surface of the storage bin 27 by weight.

For example, the rear surface of the spacing protrusion 27*c* may be in contact with a rear end of a lower surface of the lower hook body 532 of the lower hook 530. As the lift 200 gradually lowers downward, the elasticity of the spring 524 configured as the tension spring may not overcome a downward moving force of the lift 200, and the rear end of the lower surface of the lower hook body 532 of the lower hook 530 gradually slides along the rear surface of the spacing protrusion 27*c* as illustrated in FIG. 16.

The spacing protrusion 27*c* may be received in the protrusion groove 532*b* provided in the lower hook body 532, and the lower hook 530 and the upper fastener 510 may be spaced apart from each other and For example may be not engaged with each other. For example, the spacing protrusion 27*c* may be received in the protrusion groove 532*b*, and the lower fastener 520 and the upper fastener 510 may be separated from each other such that the lock 500 may be unlocked. For example, the lift 200 may be in a state which can be unfolded. To maintain the folded state of the lift 200, the spacing protrusion 27*c* may escape from the protrusion groove 532*b*.

As described above, to take out the lift 200 upward while the lift 200 sits on the bottom surface of the storage bin 27, the handle 215 may be lifted upward while the handle may be held by each of the hands. While the lift 200 rotates counterclockwise relative to the front end part thereof, the rear end part thereof (a right end of FIG. 16) may be lifted upward.

When the rear end part of the lift 200 moves upward, the rear end of the lower surface of the lower hook body 532 of the lower hook 530 gradually may be moved upward by sliding along the rear surface of the spacing protrusion 27*c*. When the rear end of the lift 200 moves up, the lift 200 slants gradually. Since the spring 524 may be the tension spring, the spring continuously pulls the lower hook 524 forward. For example, the lower hook 524 moves forward while moving upward gradually and thus may be engaged with the upper fastener 510.

For example, as illustrated in FIG. 17, before the lower end of the lower hook 524 moves away from the upper end of the spacing protrusion 27*c*, the lower hook 524 and the upper fastener 510 may be engaged with each other. For example, the lift 200 may be inclined at about 3 degrees relative to the bottom surface of the storage bin 27, such that the lower hook 524 and the upper fastener 510 may be engaged with each other.

Since the lower hook 524 of the lower fastener 520 and the upper fastener 510 may be engaged with each other when the rear end part of the lift 200 may be lifted upward, the lift 200 may be maintained at the folded state and the scissor side connection part 250 deviates from the connection hole 27*b* of the storage bin 27. For example, the lift 200 may be completely removed from the upper side of the storage bin 27.

Although the present disclosure has been described for illustrative purposes, those skilled in the art will appreciate that various modifications, additions and substitutions may be possible, without departing from the scope and spirit of the disclosure as disclosed in the accompanying claims.

For example, although the handle 215 has been described as being provided at a side surface of the rear end part of the support plate 210, the handle 215 may also be provided at the rear end of the support plate 210. For example, the handle 215 may be provided at the rear edge 216. In addition, although the handle 215 may be configured to be recessed from the inner surface of the side edge 214 to the outer side thereof, handle 215 may also be configured to pass through the side edge 214 or to pass through the rear edge 216.

Aspects of the present disclosure provide a refrigerator, wherein a lift provided in a drawer to move a container upward and downward may be easily removed therefrom. In addition, aspects of the present disclosure provide a refrigerator, wherein a lift having a scissor type link structure may be removed to an outside while the lift may be folded. Furthermore, according to aspects of the present disclosure, a handle allowing a user to hold a lift may be provided at a rear end thereof, whereby during removing of the lift, an anti-loosening device automatically operates to maintain a folded state of the lift.

According to one aspect of the present disclosure, a refrigerator may include a cabinet having a storage chamber therein, a door provided such that an opening of the cabinet may be open and closed, and a lift provided in the storage chamber so as to move a container upward and downward, wherein the lift may be removed to the outside with the lift folded. The refrigerator may include the lift received in the storage chamber to move the container upward and downward, and the lift maintains a folded state thereof by an anti-loosening device when the lift may be removed upward to the outside.

In the refrigerator, since the lift is slanted to a side while the lift is removed to the outside, the lift, which moves the container upward and downward, received in the storage chamber is automatically locked by a lock such that the lift maintains the folded state thereof.

In the refrigerator, the handle may be provided at each of rear end of the lift when received in the storage chamber, and when a user grasps and lifts the lift, the lift may be automatically rotated relative to a front end thereof to maintain the state thereof folded by the lock. In the refrigerator, the handle by which the lift received in the storage chamber may be grasped, may be provided at the rear end part of the lift, and when the lift is removed to the outside, the lift may be configured to be removed upward with the lift slanting to a side.

In the refrigerator, the handle by which the lift received in the storage chamber may be grasped may be provided at the rear end part of the lift, and the handle may be configured to have a recessed shape in which a user's fingers may be placed or to have a through hole through which a user's fingers pass.

In the refrigerator, the handle by which the lift received in the storage chamber may be grasped may be provided at the rear end part of the lift, and the handle may be configured to be integrated with the lift or may be a structure independent of the lift to be mounted to the lift.

The refrigerator may include: a cabinet having a storage chamber provided therein and an opening; at least one door provided such that a front of the storage chamber provided in the cabinet may be opened and closed; a cooling device cooling the storage chamber; a lift provided at a side of the storage chamber to fold downward and unfold upward so as to move a container upward and downward in which food may be stored; and an anti-loosening device provided at a side of the lift and allowing the lift to rotate relative to a front end thereof when the lift is removed upward so as to maintain a folded state of the lift. In addition, the anti-loosening device may include a lock preventing the lift from unfolding, and a handle provided on each of rear end parts of the lift and held by a user.

A support plate may be provided on an upper end of the lift to have a shape corresponding to a shape of a lower end of the container so as to support the lower end of the container, and the handle may be provided in the support plate. Each of edges of the support plate may protrude upward to have a particular height and an inner part of each of the edges may be configured to be depressed downward such that the lower end of the container may be easily seated.

The edges of the support plate may include: a front edge provided by protruding upward from a front end of an upper surface thereof; a pair of side edges provided by protruding upward from opposite sides of the upper surface; and a rear edge provided by protruding upward from a rear end of the upper surface.

The handle may be provided on each of rear end parts of the pair of side edges. The handle may be provided on each of the side edges to have a pair of handles, the pair of handles being symmetrical to each other. In addition, a pair of handles may be configured to be recessed from each of opposite inner surfaces of the pair of side edges to an outer side thereof.

The door may be a drawer including: a storage bin having a containing space or receiving the container therein, and a front panel provided at a front of the storage bin to be integrated therewith so as to constitute an outer surface of the front, and the lift may be installed in the storage bin.

The lift may include: an upper frame provided at an upper side thereof; a lower frame provided at a lower side of the upper frame; and a pair of scissor assemblies arranged between the upper frame and the lower frame, wherein the lock may include a lower fastener provided in the lower frame and an upper fastener provided in the upper frame.

The lower fastener may include: a locking mechanism casing fixed to a middle of the lower frame; a lower hook moving in the locking mechanism casing; and a spring applying a unidirectional force to the lower hook. The lower hook may include: a lower hook body having a particular vertical height; a support end provided at a lower end of the lower hook body to support the lower hook body; and a lower hook end protruding by perpendicularly bending from an upper end of the lower hook body.

The hook hole may be provided in an upper surface of the locking mechanism casing to have a particular front to rear length by being vertically formed through the upper surface, and the lower hook body may be provided by vertically passing through the hook hole. The front to rear length of the hook hole may be configured to have a size larger than a size of a front to rear thickness of the lower hook body provided to pass through the hook hole, and the lower hook body may be allowed to move a particular distance forward and backward while the lower hook body may be received in the hook hole.

The support end may be configured to extend forward and backward at the lower end of the lower hook body and to extend vertically therefrom and move forward and backward in the locking mechanism casing. The spring may be provided in the locking mechanism casing to push or pull the lower hook to a side by an elastic force. Furthermore, the spring may be configured as a tension spring and pulls the lower hook forward by tensile elasticity. The upper fastener may be provided by protruding downward from a lower surface of the upper frame. The upper fastener may have a shape corresponding to a shape of the lower hook such that the upper fastener and the lower hook may be engaged with each other.

An inner part of the lower hook body may be configured to be hollow such that a lower part of the lower hook body may be open and has a protrusion groove, and the storage bin may include a spacing protrusion provided on a middle part thereof by protruding upward therefrom, wherein when the spacing protrusion may be received in the protrusion groove, the lower fastener and the upper fastener may be separated from each other.

The upper fastener may include an upper hook body constituting a body thereof, and an upper hook end provided at a lower end of the upper hook body by perpendicularly bending therefrom to a side thereof. In addition, each of a front surface of the lower hook end and a rear surface of the upper hook end may be configured as an inclined surface to be parallel with each other.

A lower surface of the lower hook end may be configured to be horizontal and the front surface thereof may be configured to be the inclined surface, and an upper surface of the upper hook end may be configured to be horizontal and the rear surface thereof may be configured to be the inclined surface. The front surface of the lower hook end may be configured to be the inclined surface having height gradually decreasing forward, and the rear surface of the upper hook end may be configured to be the inclined surface having height gradually increasing backward.

According to the refrigerator, the lift may be provided in the storage bin of the refrigerator to move a container upward and downward, and such a lift maintains a folded state thereof due to the anti-loosening device when the lift may be removed to the outside. For example, according to the present disclosure, the lift may be easily removed to the outside. For example, since the lift may be removed in the folded state thereof, the removing operation of the lift may be simple and convenient, compared to when the lift may be removed to the outside with the lift unfolded.

In addition, a handle may be provided at each of the rear end parts of the lift. For example, when a user holds and lifts the lift by a hand, the lock automatically operates and the lift maintains the folded state thereof, whereby even without an additional manipulation, the lift may be removed to the outside with the lift folded.

Furthermore, when the lift is mounted in the storage bin of the refrigerator, the lift may be unlocked and scissor side connection parts may be received into connection holes of the storage bin. When the rear end of the lift may be moved upward, loosening of the lift may be automatically prevented by the lock, and each of the scissor side connection parts of a front end of the lift may be naturally removed from each of the connection holes of the storage bin, so that the lift may be easily removed from the storage bin.

Since the handle may be provided only on the rear end part of the lift, a user may be required to hold the handle of the rear end part to lift up the lift of the storage bin. For example, spreading of the lift which may occur when the user lifts the lift by holding the front end part or a middle part thereof may be prevented, whereby accidents may be reduced and convenience of use may be improved.

In addition, while the lock maintaining the folding of the lift may be positioned in the storage bin, the folding thereof may be automatically released by a spacing protrusion of the storage bin, whereby the upward/downward movement of the lift may be performed. Then, when the handle of the rear end part of the lift may be lifted up, the lock may be locked with the lift being folded, whereby the lift may be prevented from loosening. For example, usability may be improved by the simple structure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted For example.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/582,647 filed Sep. 25, 2019, U.S. application Ser. No. 16/582,518 filed Sep. 25, 2019, U.S. application Ser. No. 16/582,605 filed Sep. 25, 2019, U.S. application Ser. No. 16/582,712 filed Sep. 25, 2019, U.S. application Ser. No. 16/582,756 filed Sep. 25, 2019, U.S. application Ser. No. 16/582,810 filed Sep. 25, 2019, U.S. application Ser. No. 16/582,668 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,284 filed Sep. 27, 2019, U.S. application Ser. No. 16/585,301 filed Sep. 27, 2019, and U.S. application Ser. No. 16/585,816 filed Sep. 27, 2019, whose entire disclosures are also hereby incorporated by reference.

What is claimed is:

1. A refrigerator, comprising:

a cabinet having a storage chamber provided therein and an opening to access the storage chamber;

a door to open and close the opening of the cabinet;

a lift that is configured to be received in the storage chamber, the lift including an upper frame provided at an upper side thereof, a lower frame provided at a lower side of the upper frame, and one or more legs that fold downward and unfold upward vertically to move a container; and a lock including a lower fastener provided in the lower frame; and a handle provided at a rear end of the lift and configured to be held by a user, the lower fastener being movably provided in the lower frame and engaged to the upper frame when the lift is held by a user at the handle to be removed from the storage chamber, the lower fastener preventing the one or more legs from unfolding upward.

2. The refrigerator of claim 1, wherein a support plate is provided on an upper end of the lift to support the container, and the handle is provided in the support plate.

3. The refrigerator of claim 2, wherein one or more edges of the support plate protrude upward to seat the container on the support plate.

4. The refrigerator of claim 3, wherein the edges of the support plate include:

a pair of side edges provided at opposite sides of the upper surface; and wherein the handle is provided on one of the side edges.

5. The refrigerator of claim 4, wherein the lift includes the handles that are provided at the rear end part of the side edges.

6. The refrigerator of claim 5, wherein the handles is configured to be recessed from a corresponding one of the side edges.

7. The refrigerator of claim 1, wherein the door is a drawer including:

a storage bin to receive the container therein and to be positioned in the storage chamber when the drawer is closing the opening; and a front panel provided at a front of the storage bin and be positioned at the front of the cabinet when the drawer closes the opening, wherein the lift is configured to be installed in the storage bin.

8. The refrigerator of claim 7, wherein the lock includes an upper fastener provided in the upper frame, the lower fastener and the upper fastener being coupled together when the lock is engaged.

9. The refrigerator of claim 8, wherein the lower fastener includes:

a locking mechanism casing fixed to a middle of the lower frame;

a lower hook moving in the locking mechanism casing; and a spring that applies a force to the lower hook.

10. The refrigerator of claim 9, wherein the lower hook includes:

a lower hook body having a particular vertical height;

a support end provided at a lower end of the lower hook body to support the lower hook body; and a lower hook end protruding from an upper end of the lower hook body.

11. The refrigerator of claim 10, wherein a hook hole is provided in an upper surface of the casing and formed through the upper surface to have a particular front to rear length, and the lower hook body vertically passes through the hook hole.

12. The refrigerator of claim 11, wherein the front to rear length of the hook hole is larger than a front to rear thickness of the lower hook body such that when the lower hook body is received into the hook hole, the lower hook body moves a particular distance forward and backward.

13. The refrigerator of claim 12, wherein the support end is configured to extend forward and backward at the lower end of the lower hook body and to extend vertically therefrom and moves forward and backward in the casing, and the spring is provided in the casing and applies an elastic force to push or pull the lower hook to a side of the casing.

14. The refrigerator of claim 13, wherein the spring is a tension spring that pulls the lower hook forward by tensile elasticity.

15. The refrigerator of claim 10, wherein the upper fastener protrudes downward from a lower surface of the upper frame and has a shape corresponding to a shape of the lower hook such that the upper fastener and the lower hook are configured to engage each other when the lock is engaged.

16. The refrigerator of claim 15, wherein an inner region of the lower hook body is hollow and a lower end of the lower hook body is open and has a protrusion groove, and the storage bin includes a spacing protrusion extending upward on a middle part thereof, wherein when the spacing protrusion is received in the protrusion groove, the lower fastener and the upper fastener are separated from each other.

17. The refrigerator of claim 16, wherein the upper fastener includes an upper hook body, and an upper hook end extending from a side of the upper hook body at a lower end of the upper hook body.

18. The refrigerator of claim 17, wherein a front surface of the lower hook end and a rear surface of the upper hook end are inclined to be parallel with each other.

19. The refrigerator of claim 18, wherein a lower surface of the lower hook end is horizontal and the front surface thereof is inclined to have height that gradually decreases forward, and an upper surface of the upper hook end is horizontal and the rear surface thereof is inclined to have height that gradually increases backward.

20. The refrigerator of claim 1, wherein the lower fastener is provided movably forward and backward of the lower frame.

21. The refrigerator of claim 1, wherein the lower fastener is moved toward the door and engaged to the upper frame when the lift is held by a user at the handle to be removed from the storage chamber.

22. The refrigerator of claim 3, wherein the edges of the support plate include:

a rear edge provided at rear end of the upper surface, wherein the handle is provided on the rear edge.

* * * * *